US008033053B2

(12) United States Patent
Anderson et al.

(10) Patent No.: US 8,033,053 B2
(45) Date of Patent: Oct. 11, 2011

(54) SECURITY BARRIER SYSTEM

(75) Inventors: Joe W. Anderson, Knoxville, TN (US); Victor J. Kaminsky, Knoxville, TN (US); Thomas A. Lancaster, III, Oak Ridge, TN (US); Douglas J. Hornstra, Knoxville, TN (US); Michael W. Light, Knoxville, TN (US); James C. Powers, Oak Ridge, TN (US); Richard W. Schenk, Rockford, TN (US)

(73) Assignee: Performance Development Corporation, Oak Ridge, TN (US)

( * ) Notice: Subject to any disclaimer, the term of this patent is extended or adjusted under 35 U.S.C. 154(b) by 1194 days.

(21) Appl. No.: 11/341,310

(22) Filed: Jan. 27, 2006

(65) Prior Publication Data

US 2007/0101649 A1 May 10, 2007

Related U.S. Application Data

(63) Continuation-in-part of application No. 10/777,932, filed on Feb. 12, 2004, now Pat. No. 7,121,041.

(51) Int. Cl.
*E01F 13/00* (2006.01)

(52) U.S. Cl. ..... 49/49; 404/6; 49/381

(58) Field of Classification Search ..... 49/49, 381, 49/388, 70, 501, 9, 34; 256/73, 131, 1; 404/1, 404/6, 10; 52/174

See application file for complete search history.

(56) References Cited

U.S. PATENT DOCUMENTS

| | | | | |
|---|---|---|---|---|
| 391,526 | A | | 10/1888 | Foran |
| 1,437,404 | A | * | 12/1922 | Donovan ..... 49/34 |
| 1,601,311 | A | * | 9/1926 | Koski ..... 49/9 |
| 1,711,243 | A | | 4/1929 | Neeld |
| 2,263,649 | A | * | 11/1941 | Sawyer ..... 49/9 |
| 2,324,726 | A | | 7/1943 | Sawyer |
| 4,152,871 | A | | 5/1979 | Kardash, Jr. |
| 4,263,749 | A | * | 4/1981 | McDougle ..... 49/394 |
| 4,576,507 | A | | 3/1986 | Terio |
| 4,628,638 | A | | 12/1986 | Elko et al. |
| 4,759,655 | A | | 7/1988 | Gorlov |
| 4,780,020 | A | | 10/1988 | Terio |
| 4,844,653 | A | | 7/1989 | Dickinson |
| 4,989,835 | A | * | 2/1991 | Hirsh ..... 256/13.1 |
| 5,118,056 | A | | 6/1992 | Jeanise |
| 5,136,813 | A | | 8/1992 | Gibbs et al. |
| 5,261,187 | A | | 11/1993 | Prenger |
| 5,299,781 | A | | 4/1994 | Barrett et al. |
| 5,395,105 | A | | 3/1995 | Thommen |
| 5,634,738 | A | | 6/1997 | Jackson et al. |
| 5,740,629 | A | | 4/1998 | Fischer et al. |

(Continued)

OTHER PUBLICATIONS

A collection of 3 photographs of two different gates supposedly installed in a government facility at least as early as Oct. 2002.

*Primary Examiner* — Gregory J. Strimbu

(74) *Attorney, Agent, or Firm* — Luedeka, Neely & Graham, PC

(57) ABSTRACT

A security barrier apparatus which may be used in conjunction with an existing security gate or may be used as a stand-alone security barrier gate. The system uses a passive restraining device comprising a bollard having at least one catch horn extending therefrom which engages a corresponding structure on the gate to restrain the gate when impacted.

16 Claims, 27 Drawing Sheets

U.S. PATENT DOCUMENTS 5,762,443 A 6/1998 Gelfand et al.
5,829,912 A 11/1998 Marcotullio et al.
5,984,569 A * 11/1999 Chou ..... 404/6
5,987,816 A 11/1999 Fischer et al.
6,092,338 A 7/2000 Crowner et al.
6,119,399 A * 9/2000 McCain et al. ..... 49/340
6,382,869 B1 5/2002 Dickinson
6,792,716 B1 * 9/2004 Luster ..... 49/49
6,843,613 B2 1/2005 Gelfand et al.
6,857,227 B2 * 2/2005 Russell ..... 49/49
7,121,041 B2 * 10/2006 Anderson et al. ..... 49/49
2004/0175231 A1 * 9/2004 Reale ..... 404/6
2005/0031409 A1 * 2/2005 Behan et al. ..... 404/6
2005/0199868 A1 * 9/2005 Morris ..... 256/73

* cited by examiner

SECURITY BARRIER SYSTEM

The present application is a continuation-in-part of U.S. application Ser. No. 10/777,932, filed Feb. 12, 2004 now U.S. Pat. No 7,121,041.

FIELD

This invention relates to the field of gate systems and gate reinforcement systems and techniques. More particularly, the invention relates to an apparatus for replacing or for improving host gate systems.

BACKGROUND OF THE INVENTION

With heightened security requirements at facilities across the country and overseas, an increased need has developed for devices that can easily operate as gates or gated barriers and meet necessary crash barrier requirements. Such devices may be entirely stand-alone systems or the devices may act as an upgrade or improvement to previously existing gates or gated barriers.

A prior art device in use at Argonne National Laboratory since the mid-1980s provides an approach that has been improved with the present invention. The prior art device is simply a straight steel pipe with a wire rope cable through it. The cable ends are connected so that the cable forms a loop, part inside and part outside the pipe. The pipe is attached to the fence and the cable loop hangs below the pipe. A variation of the prior art device appears to include metal standoffs welded to the pipe and clamped to the cable to hold the cable above the pipe. The pipe is attached to the gate, and two bollards with hooks will catch the cable loop when impacted in such a way that the pipe passes through the bollards.

One weakness of both the prior art devices is that they permit the full force of impact to bear as a concentrated load on a single point in the cable. Additionally, these systems do not provide protection against the potential cutting action of the pipe ends or the standoffs on the wire rope when either device experiences dynamic stresses such as those that result from the impact of an automobile against such a device.

The preferred embodiment of the present invention offers advantages including, but not limited to, the following: 1) providing for distribution of the loading, 2) transferring critical impact loading, 3) eliminating sharp edges that could cut a cable, 4) using an improved catch horn design, and 5) including a modified reinforcement technique for a bollard to facilitate installation. Once installed, the preferred embodiment of the present invention does not require operation of any active elements to perform its catching function.

SUMMARY OF THE INVENTION

This invention provides an an anti-ram vehicle barrier. A barrier assembly may be attached to a host swinging or sliding gate or other barrier section to improve the barrier, thereby reinforcing the gate or other barrier section and evenly distributing loading and reducing wear damage to various components of the apparatus. The invention may also be a stand alone barrier assembly. The invention also improves superposts or posts used in barrier assemblies by providing passive engagement devices and providing increased strength to barrier assembly posts and superposts.

BRIEF DESCRIPTION OF THE DRAWINGS

Further advantages of the invention are apparent by reference to the detailed description when considered in conjunction with the figures, which are not to scale so as to more clearly show the details, wherein like reference numbers indicate like elements throughout the several views, and wherein.

DETAILED DESCRIPTION OF PREFERRED EMBODIMENTS OF THE INVENTION

The detailed description that follows describes various embodiments of the invention. The embodiments are described for exemplary purposes only. It should be understood that the various embodiments discussed below may be improvements to existing security structures or entirely whole new security structures. Moreover, it should be understood that the various embodiments of security structure improvements and new security structures may be used with or include swing gates, sliding gates, vertically lowered or raised gates, and other gate mechanisms known to those skilled in the art.

Figure 1:
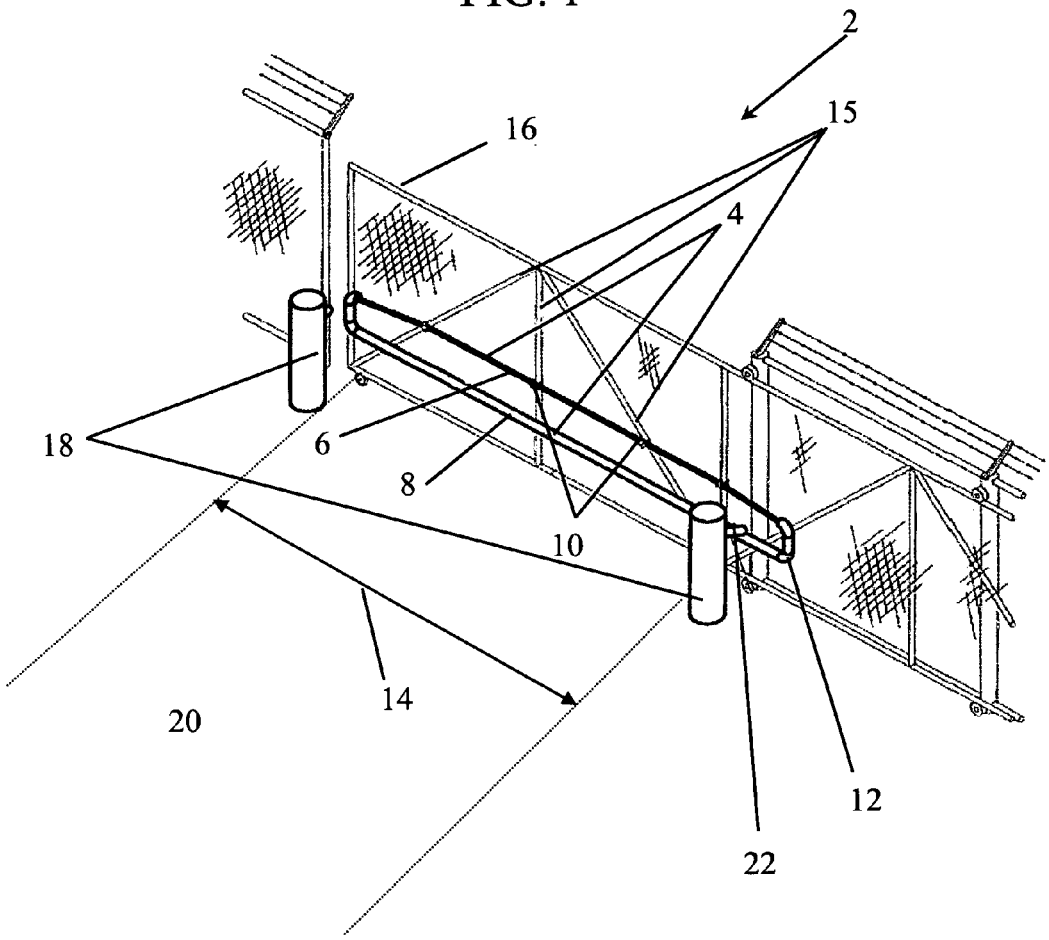
FIG. 1 is a view looking down from the protected side of one embodiment of the present invention.

An overview of a preferred embodiment of the invention is shown in FIG. 1, displaying a security barrier apparatus 2. The security barrier apparatus 2 is further broken down into an attachable assembly 4 wherein a cable, preferably a multi-strand flexible steel cable 6 from between about 1 inch to about 2 inches in diameter, is routed through a structural member 8. Those skilled in the art appreciate that any cable of sufficient strength to provide a prescribed stopping force for the purposes of this invention would suffice for this or any other similar embodiment of the invention. The structural member 8 is preferably made of galvanized or powder coated steel. The attachable assembly 4 preferably includes ends 12 that are finished so that the force of most foreseeable impacts upon the security barrier apparatus 2 is absorbed by the barrier apparatus 2 such that cutting forces from the ends 12 will be limited.

Figure 2:
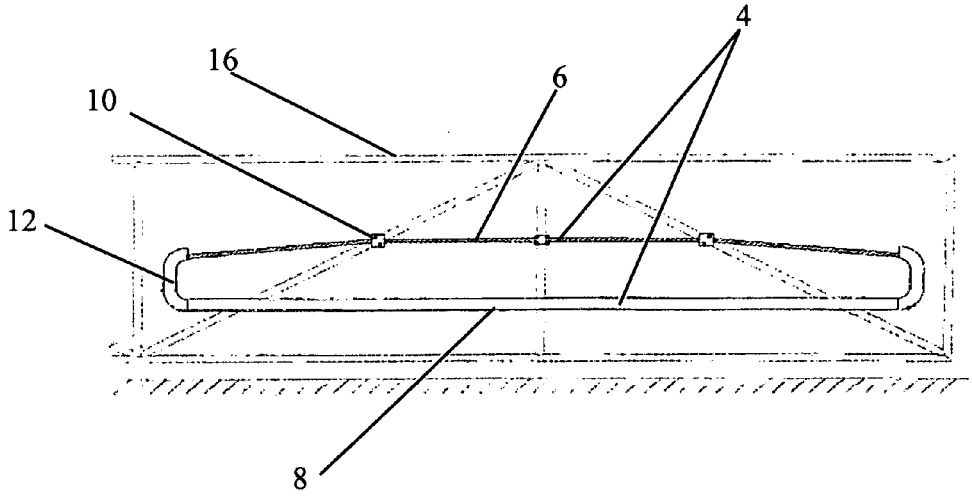
FIG. 2 is a side view looking at a gate portion and attachable assembly of one embodiment of the present invention.

The attachable assembly 4 preferably has a width sufficient to span at least as wide as an opening width 14 of the security barrier apparatus 2. The attachable assembly 4 is preferably attached to a gate portion 16 of a host gate by using one or more U-bolt brackets 10 to attach the attachable assembly 4 to one or more braces 15 on gate portion 16 or any other suitable structure on gate portion 16. Those skilled in the art, however, appreciate many other attachment means to attach the attachable assembly 4 to the gate portion 16 including, but not limited to, J bolts, V bolts, metal ties, polymer ties, chain, rope, C clamps, vises, or other attachment means. A direct lateral view of the gate portion 16 with attachable assembly 4 is shown in FIG. 2. A vertical view looking down at the gate portion 8 with attachable assembly 4 is shown in FIG. 3.

Figure 3:
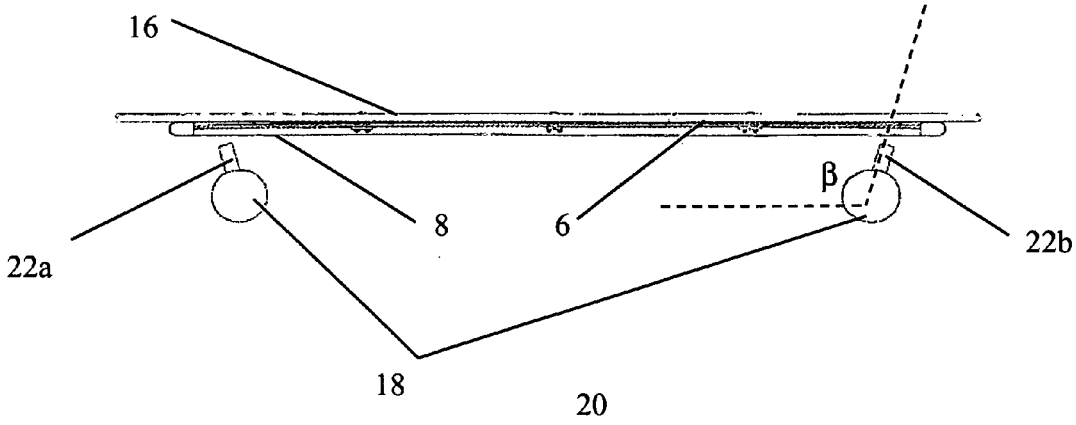
FIG. 3 is a vertical view looking directly down on a gate portion of one embodiment of the present invention.

The embodiment of the invention shown in FIG. 1, FIG. 2, and FIG. 3 further includes at least two superposts 18 that are spaced to permit passage when the security barrier apparatus 2 is in a substantially open position. The superposts 18 are preferably reinforced and anchored with suitable anchoring means such as metal rebar reinforced concrete cement and the like. The superposts 18 are preferably located on the protected side 20 of the gate 16. The superposts 18 each house at least one catch horn 22 to help snare the assembly if an adequate force is applied to the security barrier apparatus 2.

Figure 4:
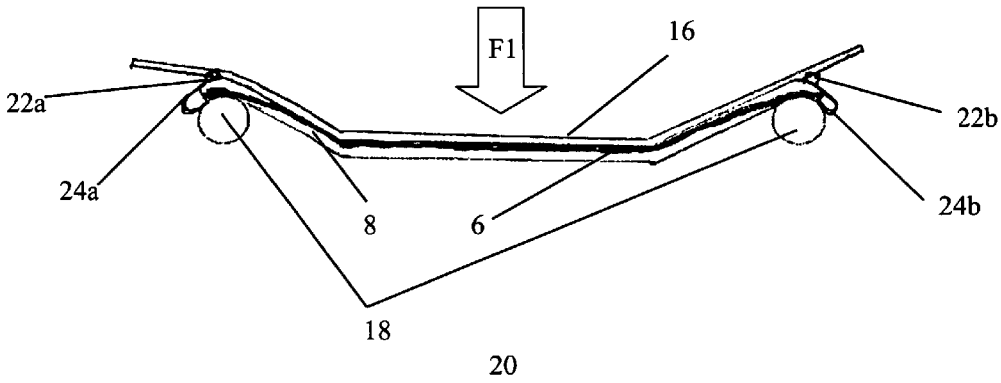
FIG. 4 is a vertical view looking directly down on a gate portion, attachable assembly, and bollards of one embodiment of the present invention after the security barrier apparatus has been struck by an incoming object such as a car.

When an adequate force such as force F1 is applied to the security barrier apparatus 2 as shown in FIG. 4, the attachable assembly 4 may buckle and be moved substantially in the direction of force F1 toward the superposts 18. As force F1 moves the attachable assembly 4, a first end portion 24*a* and a second end portion 24*b* of the attachable assembly 4 are hindered by a first catch horn 22*a* and a second catch horn 22*b* (hereinafter referred to together as catch horns 22), thereby substantially absorbing force F1 and preventing entry into the protected side 20 of the security barrier apparatus 2. The cable 6 may be formed into a loop using techniques such as splicing, multiplicity of rope clamps, or other means known to those skilled in the art. The structural member 8 is preferably formed without sharp edges that could cut the cable 6. The superposts 18 and catch horns 22 are also preferably formed without sharp edges.

Figure 5A:
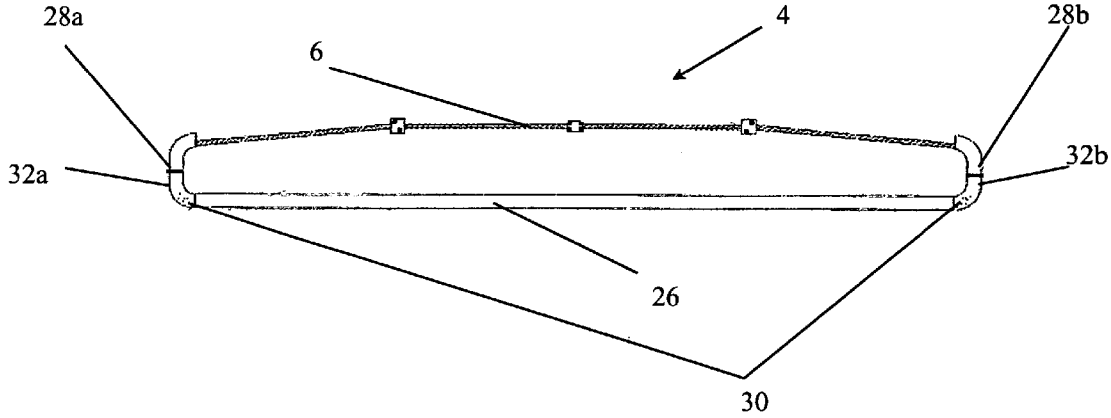
FIG. 5*a* is a side view of an embodiment of an attachable assembly for use with embodiments of the present invention.

Referring now to FIG. 5, the attachable assembly 4 with cable 6 and structural member 8 is shown in more detail. The structural member 8 could be formed from any pipe, tube, beam, channel, or like structure of sufficient strength and flexibility that can withstand the anticipated forces that may act upon various embodiments of the invention. Such anticipated forces include those that are as powerful as about $1.1\times 10^6$ ft-lb/s when acting on the security barrier apparatus 2. The structural member 8 is preferably configured with substantially smooth contours to minimize sharp surfaces or edges that may cut the cable 6 if a substantial force is applied to the security barrier apparatus 2. In a preferred embodiment, the structural member 8 is four inch "schedule 40" or heavier steel pipe. In this embodiment, the structural member 8 is made up of one straight section 26, a first end section 28*a*, and a second end section 28*b* (hereinafter referred to together as end sections 28). The end sections 28 are preferably butt-welded to opposing ends of the straight section 26.

To aid in removing rainwater or condensation that may collect in the structural member 8 of this embodiment, small holes 30 may be drilled in a first bottom elbow 32*a* and a second bottom elbow 32*b* of the end sections 28. Removing liquid buildup in the structural member 8 helps to prevent both corrosion and excessive weight on the attachable assembly 4.

FIGS. 6*a*, 6*b*, 6*c*, and 6*d* provide a more detailed view of an example of a superpost 18 used in certain preferred embodiments of the invention. The superposts 18 are preferably made up of about an eight feet long "schedule 40" or heavier twelve inch diameter pipe 36 acting as a shell. It should be noted, however, that in other preferred embodiments the length of pipe 36 may range from about six feet to about twenty feet. Similarly, the inside cross sectional length of the pipe 36 ranges from between about eight inches to about sixteen inches. Pipe 36 is preferably made of metal, preferably galvanized steel. Inside the pipe 36 a reinforcing I-beam 38 is preferably located substantially along the centerline of the pipe 36, wherein the I-beam's 38 dimensions are preferably about 8×18×96 inches. In the embodiment shown in FIG. 6*a*, the I-beam 38 extends about seven feet, starting from about the base 40 of the superpost 18. The I-beam 38 is preferably centered by the aid of short pieces of metal rebar 42 that are attached to the I-beam 38 by welding or other attachment means known to those skilled in the art. It should be appreciated that the I-beam 38 may be centered using a wide variety of materials including metal pieces, wood pieces, polymer structures, all of which may or may not necessarily be attached to the I-beam 38 or the pipe 36.

Figure 6A:
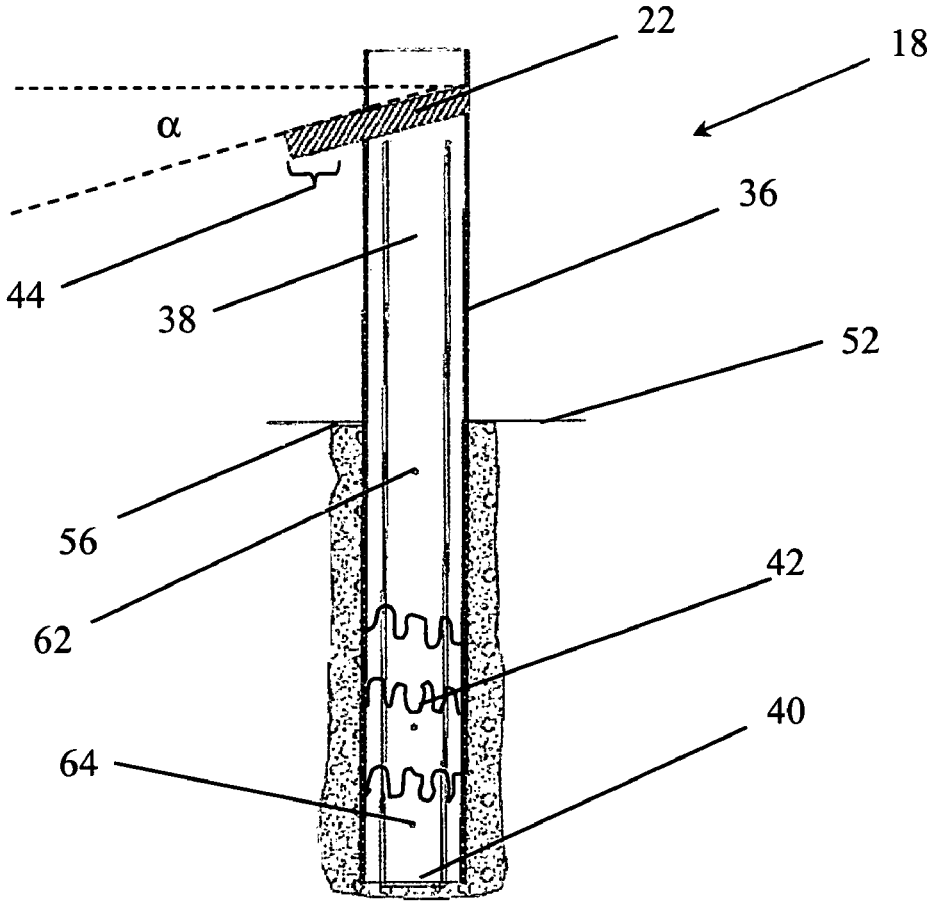
FIG. 6*a* is a side view of one of the superposts used in some embodiments of the present invention.
Figure 6B:
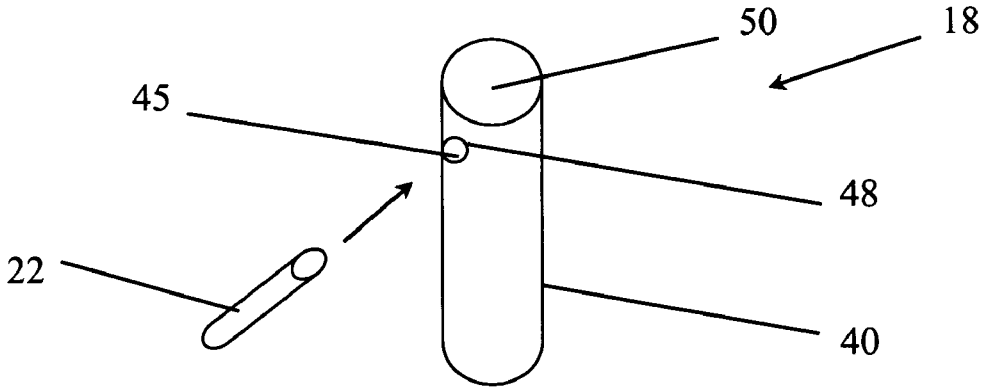
FIG. 6*b* is an above ground angled view of one of the superposts and catch horns used in some embodiments of the present invention, showing the insertion of a segment of round stock into a superpost to form a catch horn along the superpost.
Figure 6C:
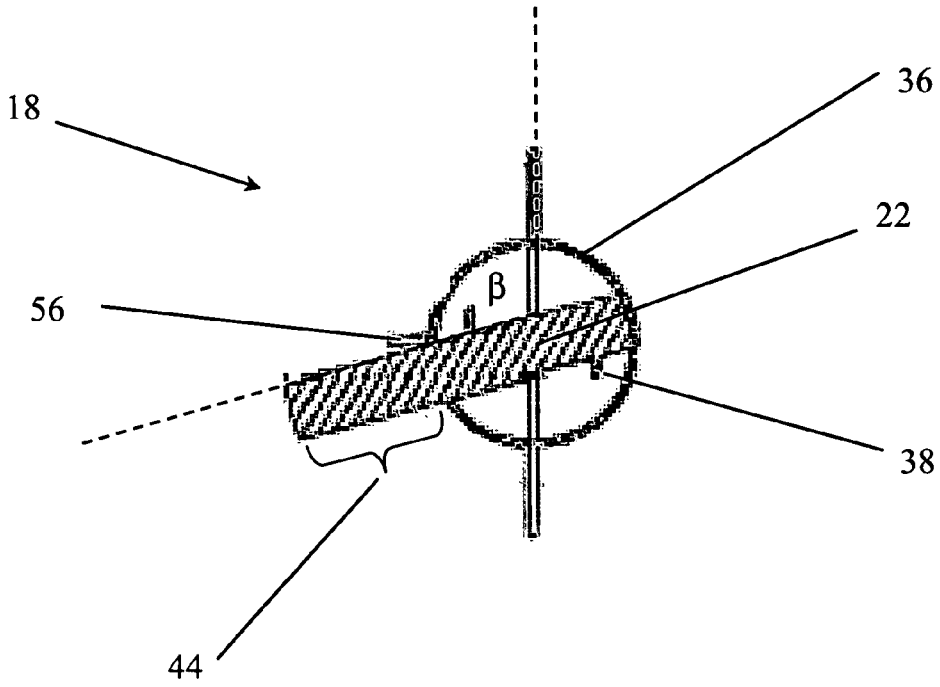
FIG. 6*c* is a vertical view looking directly down at the top of one of the superposts used in some embodiments of the present invention.

At least one catch horn 22 is formed on each superpost 18, preferably by cutting at least one hole 45 in the side of the pipe 36 and inserting an extension member 46 into a penetration point 48 in the pipe 36. The extension member 46 is preferably made of metallic round stock such as steel round stock having a diameter ranging from about 2 inches to about 4 inches. The extension member 46 is preferably attached to the pipe 36 at both the penetration point 48 and a contact point 50, the contact point 50 being the place where the extension member 46 meets the internal wall of the pipe 36 opposite the penetration point 48. The attachment means preferably consists of welding techniques or other similar attachment techniques known to those skilled in the art. The extension member 46 is preferably attached to the pipe 36 at an angle $\alpha$ from about ten degrees to about twenty degrees wherein angle $\alpha$ is oriented toward the ground 52 as shown in FIG. 6*a*. The extension member 46 is also preferably attached to the pipe 36 at an angle $\beta$ from about one-hundred and ten degrees to about one-hundred and twenty degrees wherein angle $\beta$ is oriented away from an opposing superpost 18 as shown in FIG. 3 and FIG. 6*c*.

Figure 6D:
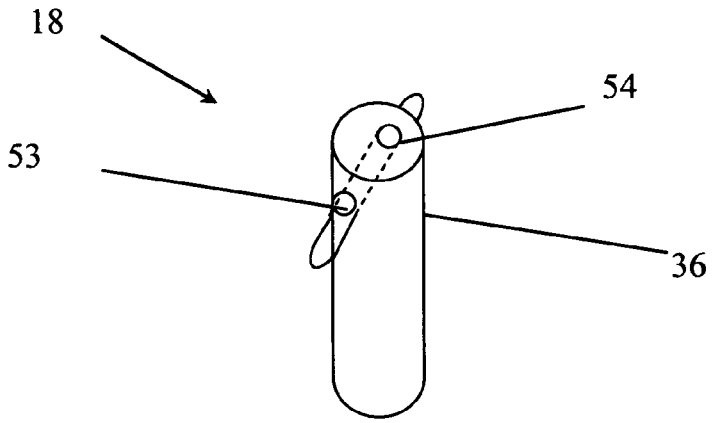
FIG. 6*d* is an above ground angled view of one of the superposts and catch horns used in some embodiments of the present invention after insertion of a segment of round stock into the superpost to form a catch horn along the superpost.

In another embodiment for superpost 18 structure as shown in FIG. 6*d*, two points of entry may be formed in the pipe 36 including a penetration point 53 and an exit point 54. The extension member 46 is preferably attached to the pipe 36 at both the penetration point 53 and the exit point 54 via welding techniques or other similar techniques known to those skilled in the art. Any protruding portion of the extension member 46 from the exit point 54 is preferably removed and ground to a substantially smooth surface prior to any galvanizing or painting of the pipe 36. In preferred embodiments, a tab 56 is attached to the pipe 36 via welding or other similar technique known to those skilled in the art at substantially ground level to indicate the desired orientation of the superpost 18.

Figure 7:
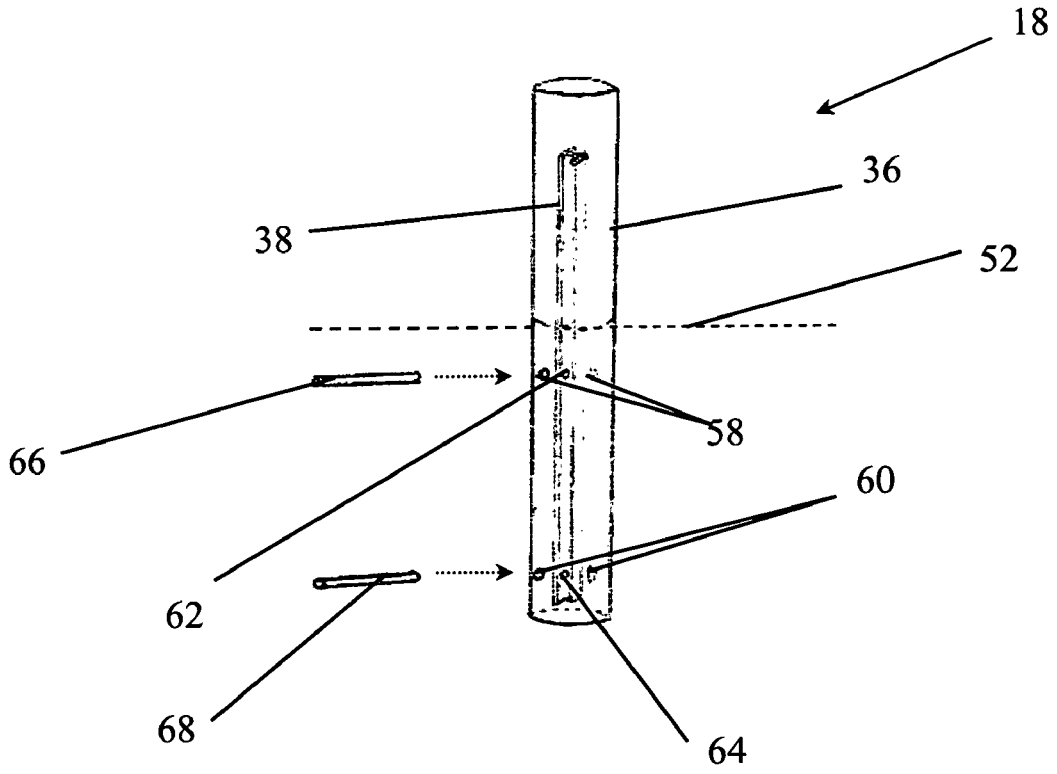
FIG. 7 is an approximate side view of a superpost, showing an I-beam within the superpost and rebar pieces to be inserted through the superpost and the I-beam.

In the embodiment shown in FIG. 6*a* and FIG. 7, at least one pair of holes is located through pipe 36 below ground level for anchoring the I-beam 38. More specifically, in the embodiment shown in FIG. 7, an upper pair of holes 58 through the pipe 36 is located between from about 0.5 feet to about 1.5 feet below ground 52 level. A second, lower pair of holes 60 through the pipe 36 is located between from about 0.5 to about 1.5 feet above the base 40. The diameters of both the upper pair of holes 58 and lower pair of holes 60 preferably range from between about 0.5 inches to about 1.5 inches. In similar fashion, in the preferred embodiment shown in FIG. 6*a* and FIG. 7, at least one hole is located through the I-beam 38. An upper I-beam hole 62 is located through the I-beam 38, whereby upper I-beam hole 62 may be oriented in a corresponding relationship with the upper pair of holes 58 in the pipe 36. Similarly, a lower I-beam hole 64 is located through the I-beam 38, whereby lower I-beam hole 64 may be oriented in a corresponding relationship with the lower pair of holes 60 in the pipe 36.

During construction of bollard 34, the I-beam 38 may be held in place vertically within the pipe 36 by inserting an upper stabilizing member 66 through the upper pair of holes 58 and the upper I-beam hole 62, and inserting a lower stabilizing member 68 through the lower pair of holes 60 in and the lower I-beam hole 64. Upper stabilizing member 66 and lower stabilizing member 68 are preferably metallic round stock made of galvanized or stainless steel, wherein the diameter of each stabilizing member (66 and 68) preferably ranges from between about 0.5 inches to about 1.5 inches.

In this embodiment, when superpost 18 is installed into a desired substantially stationary position such as when inserted into the ground 52 in FIG. 6*a*, preferably over one half of the superpost 18 length is buried or submerged in order to substantially immobilize the superpost 18. The example shown in FIG. 6*a* represents a superpost 18 of about eight feet in length in which approximately five feet of the superpost 18 are buried or submerged. After the immobilization step in this embodiment, a reinforcing step is preferable in which concrete or other similar fixing agent may be poured into and around the pipe 36 structure, thereby reinforcing the stationary position of superpost 18.

Referring back to FIG. 1-5, in a preferred embodiment, the superposts 18 are located close enough to the attachable assembly 4 to ensure that the end portions 24 of the attachable assembly 4 will be snared by the catch horns 22*a* and 22*b* when the security barrier apparatus 2 is impacted with an adequate force such as force F1. A preferable distance between the superposts 18 and the attachable assembly 4 ranges from about one inch to about three inches. However, the effective distance may vary depending on the size and specific application of the security barrier apparatus 2 being used.

Figure 5B:
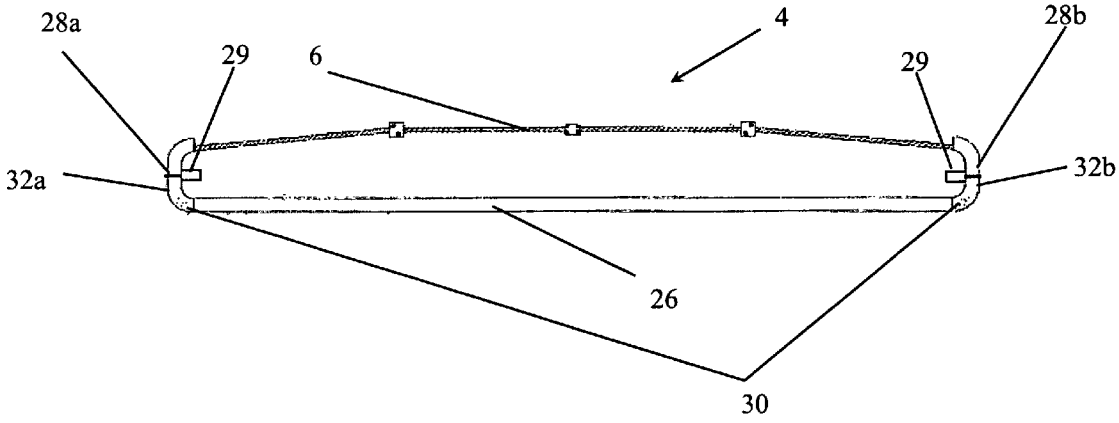
FIG. 5*b* is a side view of an alternate embodiment of an attachable assembly for use with embodiments of the present invention.

An alternate embodiment of the attachable assembly 4 is shown in FIG. 5*b*, wherein catch pins 29 are located on the end sections 28. The catch pins 29 assist to ensure that the attachable assembly 4 properly engages the catch horns 22*a* and 22*b* when the security barrier apparatus 2 is impacted.

Figure 8:
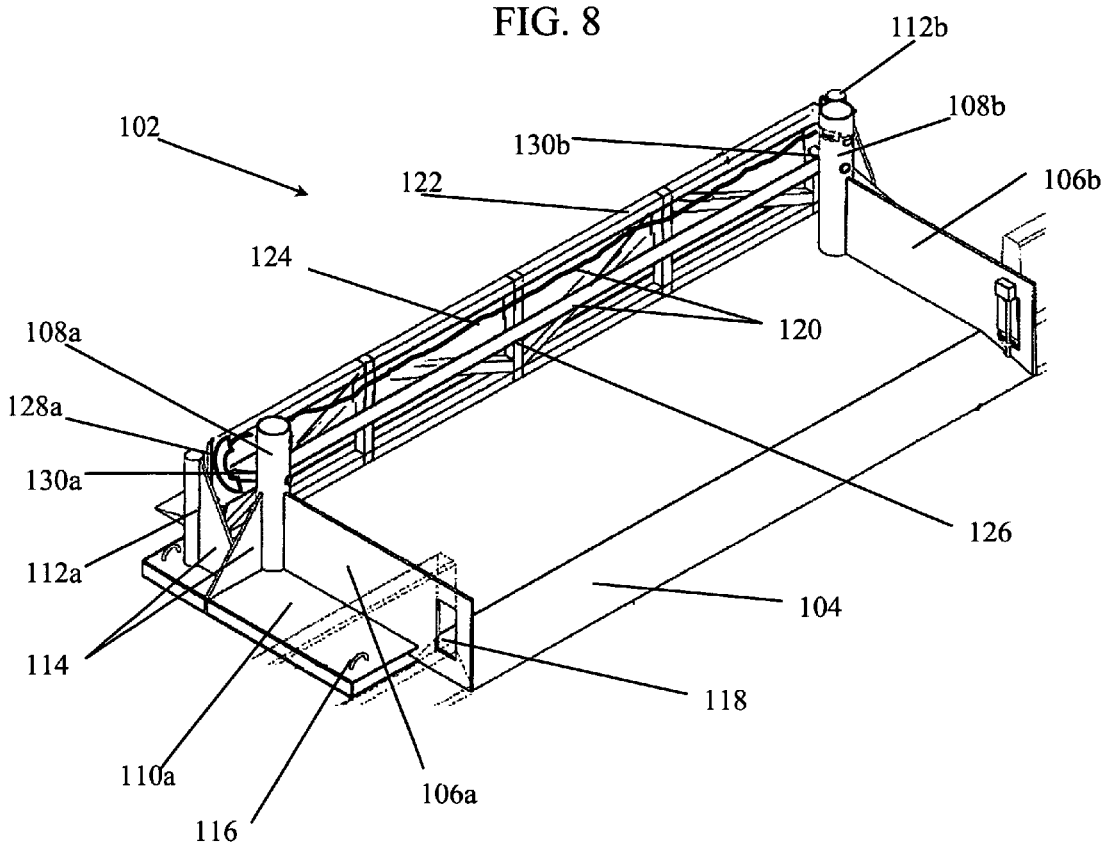
FIG. 8 is a view looking down on one embodiment of the present invention that is substantially entirely above ground and uses an attachable assembly that includes at least one metal cable.

It should be appreciated that in some conditions, it might be desirable to use an anchoring technique other than as discussed above, such as using a baseplate with anchoring gussets, or using other similar anchoring techniques known to those skilled in the art. One such embodiment is shown in FIG. 8 wherein a security barrier apparatus 102 is displayed.

The security barrier apparatus 102 includes a base plate 104, preferably made of galvanized steel, attached to a first side plate 106*a* and a second side plate 106*b* (hereinafter referred to together as side plates 106) both of which are preferably made of galvanized steel. Side plate 106*a* is attached to a first superpost 108*a* and a first footplate 110*a*. Similarly, side plate 106*b* is attached to a second superpost 108*b* and a second footplate (not shown). First footplate 110*a* and second footplate 110*b* (hereinafter referred to together as footplates 110) are defined here as separate pieces from base plate 104; however, base plate 104 may extend beyond side plates 106, thereby eliminating the need to distinguish between base plate 104 and a separately defined pair of footplates 110. Superposts 108*a* and 108*b* are hereinafter referred to together as superposts 108. Both superposts 108 and footplates 110 are preferably made of galvanized or powder coated steel. A first gate post 112*a* and second gate post 112*b* (hereinafter referred to together as gate posts 112, wherein second gate post is not shown) are attached to footplate 110*a* and footplate 110*b* (not shown). Base plate 104, side plates 106, superposts 108, footplates 110, and gate posts 112 are preferably attached via welding or other similar attachment methods known to those skilled in the art.

Security barrier apparatus 102 also preferably includes support braces 114 attached to superposts 108, footplates 110, and gate posts 112. Footplates 110 preferably include one or more lifting lugs 116 to aid in transporting the security barrier apparatus 102. Support braces 114 and lifting lugs 116 are preferably attached by welding techniques or other similar attachment methods known to those skilled in the art. Side plates 106 preferably include apertures 118 so that extension members like concrete barriers and the like may be attached to the security barrier apparatus 102 as shown in FIG. 8.

An attachable assembly 120, similar to attachable assembly 4 discussed previously in other embodiments, is attached to a gate portion 122. As before, the attachable assembly 120 includes a cable 124 and structural member 126. The structural member includes a first end 128*a* and a second end 128*b* (hereinafter referred to together as ends 128). The preferred materials and attachment methods for this embodiment may be substantially the same as those discussed previously.

A first catch horn 130*a* and a second catch horn 130*b* (hereinafter referred to together as catch horns 130) protrude from superposts 108. The gate portion 122, while in a substantially closed position, is oriented such that the catch horns 130 on the superposts 108 will substantially snare ends 128 when an adequate force acts upon the attachable assembly 120 so as to move it into intimate contact with superposts 108. The term "snare" and derivates is defined herein to mean the engagement of at least one second object by at least one first object, where the first and second objects were not previously engaged, such that the at least one second object is maintained in engagement by the at least one first object under reasonably foreseeable circumstances of force.

The structure and construction of superposts 108 are similar to the structure and construction of superposts 18 as described with previously discussed embodiments, and therefore such structure and construction will not be discussed in detail here. In this embodiment and related embodiments, the gate portion 122 may or may not be attached to the gate posts 112 and its attached members. For instance, the gate portion 122 may be slid into a substantially closed position or moved into a closed position using wheels or other similar friction reducing means known to those skilled in the art without being attached to gate posts 112. However, gate portion 122 may be attached to one or both of the gate posts 112 in a manner that allows for the gate portion 122 to move so that ingress and egress is made possible through the security barrier apparatus.

Figure 9:
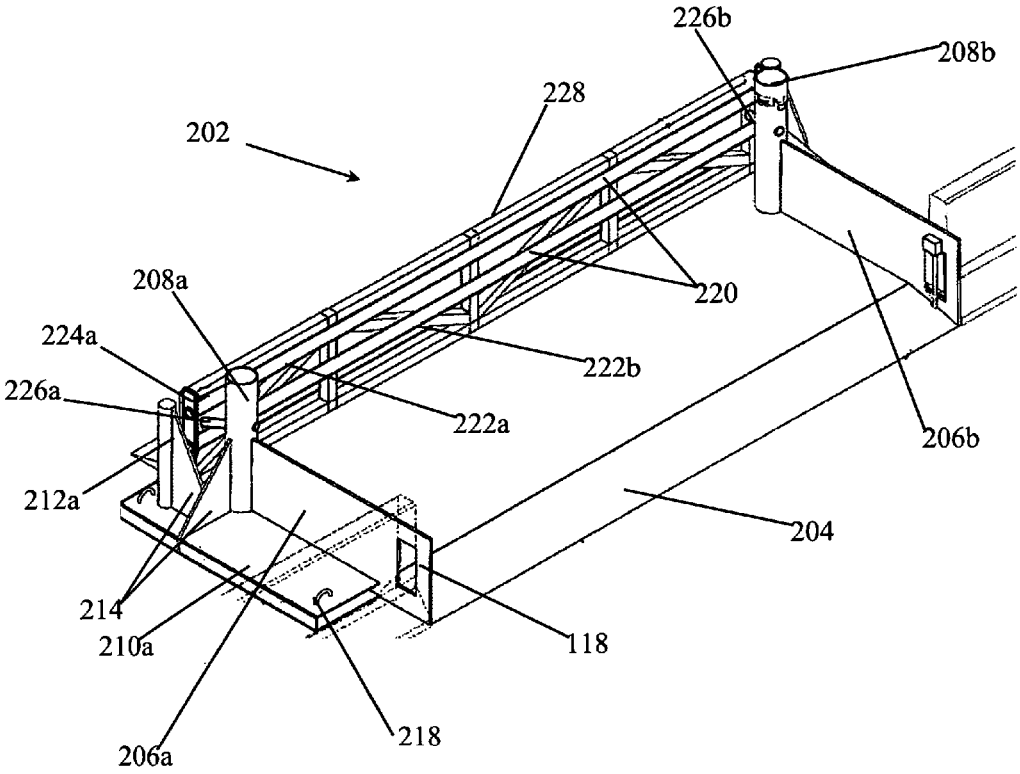
FIG. 9 is a view looking down on one embodiment of the present invention that is substantially entirely above ground and uses a double bar crash beam that may include one or more metal cables.

In another preferred embodiment of the invention shown in FIG. 9, a security barrier apparatus 202 includes a base plate 204, side plates 206, superposts 208, foot plates 210, and gate posts 212 attached in similar fashion as the embodiment shown in FIG. 8. This preferred embodiment differs, however, in that an attachable assembly 220 is made of a first crash beam 222*a*, a second crash beam 222*b*, a first end 224*a*, and a second end 224*b*. The first crash beam 222*a*, second crash beam 222*b*, first end 224*a*, and second end 224*b* are hereinafter referred to together as double crash beam 222; the first end 224*a* and second end 224*b* are hereinafter referred to together as ends 224. Catch horns 226*a* and 226*b* are preferably attached to the superposts 208 substantially similar to the catch horns shown in FIG. 8.

The embodiment shown in FIG. 9 operates in substantially the same way as previously discussed embodiments. The choice of material and construction of the various members of this embodiment including superposts 208 is similar to superposts 18 and 108 previously described in detail. Therefore, the choice of material and construction of the various members of this embodiment will not be discussed in detail.

A gate portion 228, while in a substantially closed position, is oriented such that the catch horns 226 on the superposts 208 will substantially snare ends 224 when an adequate force acts upon the attachable assembly 220 so as to move it into intimate contact with superposts 208. As with the embodiment shown in FIG. 8, the gate portion 228 shown in FIG. 9 may or may not be attached to the gate posts 212 and its attached members. The gate portion 228 may be slid into a substantially closed position or moved into a closed position using wheels or other similar friction reducing means known to those skilled in the art.

Security barrier apparatus 202 also preferably includes support braces 214 attached to superposts 208, footplates 210, and gate posts 212. Footplates 210 preferably include one or more lifting lugs 216 to aid in transporting the security barrier apparatus 202. Support braces 214 and lifting lugs 216 are preferably attached by welding techniques or other similar attachment methods known to those skilled in the art. Side plates 206 preferably include apertures 218 so that concrete barriers and the like may be attached to the security barrier apparatus 202 as shown in FIG. 9.

Figure 10:
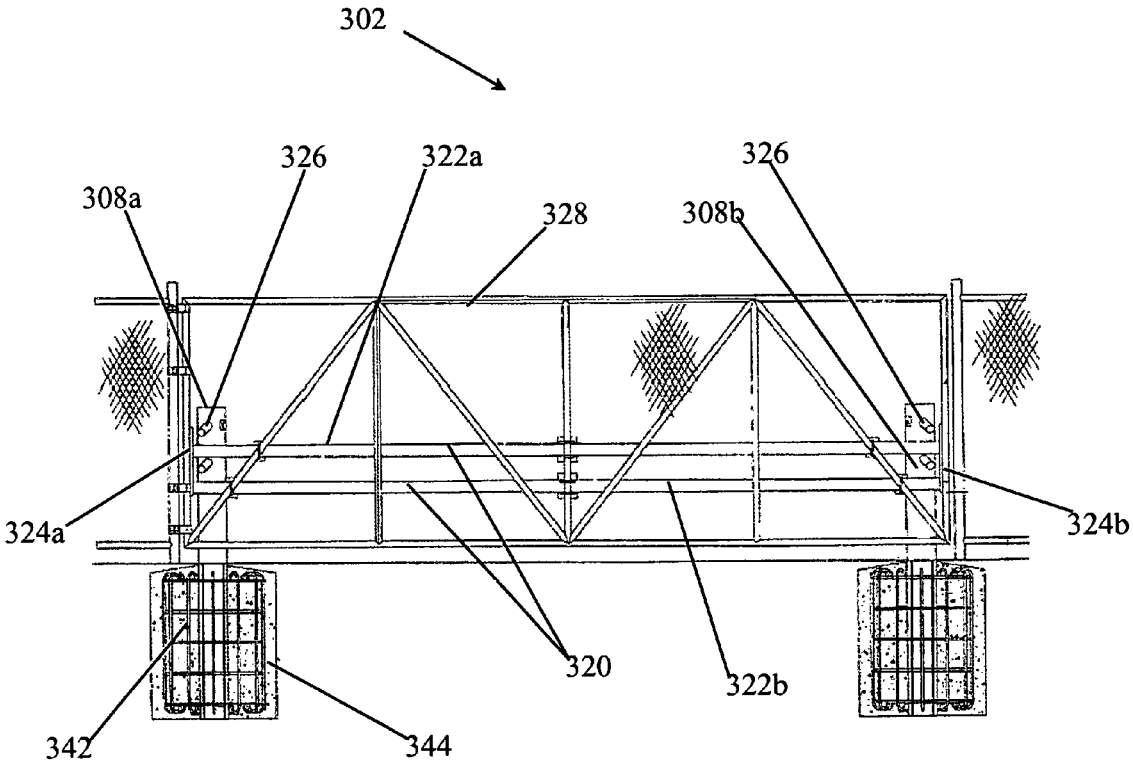
FIG. 10 is a side view of one embodiment of the present invention that includes a double bar crash beam attached to a host gate and at least two superposts that are anchored in the ground.

Yet another preferred embodiment is shown in FIG. 10, wherein a security barrier apparatus 302 is displayed including an attachable assembly 320. The attachable assembly 320 consists of a first crash beam 322*a*, a second crash beam 322*b*, a first end 324*a*, and a second end 324*b*. The first crash beam 322*a*, second crash beam 322*b*, first end 324*a*, and second end 324*b* are hereinafter referred to together as the double crash beam 322; the first end 324*a* and second end 324*b* are hereinafter referred to together as ends 324.

Unlike the embodiment shown in FIGS. 8 and 9, this embodiment is intended for use in a substantially stationary position. A first superpost 308*a* and a second superpost 308*b* (hereinafter referred to together as superposts 308) are substantially fixed, preferably using the methods discussed previously when referring to FIG. 6*a* and FIG. 7. For example, in FIG. 10, superposts 308 are substantially fixed using metal rebar 342 and concrete cement 344. Superposts 308 are constructed in similar fashion as superposts 18, previously discussed in detail. In this embodiment, superposts 308 may have a first pair of catch horns 326*a* and a second pair of catch horns 326*b*; both pairs of catch horns (326*a* and 326*b*) are hereinafter referred to together as catch horns 326.

A gate portion 328, while in a substantially closed position, is oriented such that the catch horns 326 on the superposts 308 will substantially snare ends 324 when an adequate force acts upon the attachable assembly 320 so as to move it into intimate contact with superposts 308. The gate portion 328 may be attached to an extended boundary or fencing structure in such a way as to swing to a substantially closed position, lower to a substantially closed position, or any other mechanical means of dynamic gate operation known to those skilled in the art.

In a particular preferred embodiment shown in FIG. 11, gate portion 428 is split into a first gate portion 428*a* and a second gate portion 428*b* (hereinafter referred to together as gate portions 428). Gate portions 428 are preferably attached to an extended boundary or fencing structure such that they can be swung or linearly moved to a substantially closed position. A security barrier apparatus 402 consists of a first attachable assembly 420*a* attached to first gate portion 428*a* and a second attachable assembly 420*b* attached to second gate portion 428*b*. Attachable assemblies 420*a* and 420*b* are hereinafter referred to together as attachable assemblies 420. Attachable assembly 420*a* consists of a first crash beam 422*a*, a second crash beam 422*b*, a first end 424*a*, and a second end 424*b*. First crash beam 422*a*, second crash beam 422*b*, first end 424*a*, and second end 424*b* are hereinafter referred to together as first double crash beam 422. First end 424*a* and second end 424*b* are hereinafter referred to together as first ends 424. Attachable assembly 420*b* consists of a first crash beam 423*a*, a second crash beam 423*b*, a first end 425*a*, and a second end 425*b*. First crash beam 423*a*, second crash beam 423*b*, first end 425*a*, and second end 425*b* are hereinafter referred to together as second double crash beam 423. First end 425*a* and second end 425*b* are hereinafter referred to together as second ends 425.

Figure 11:
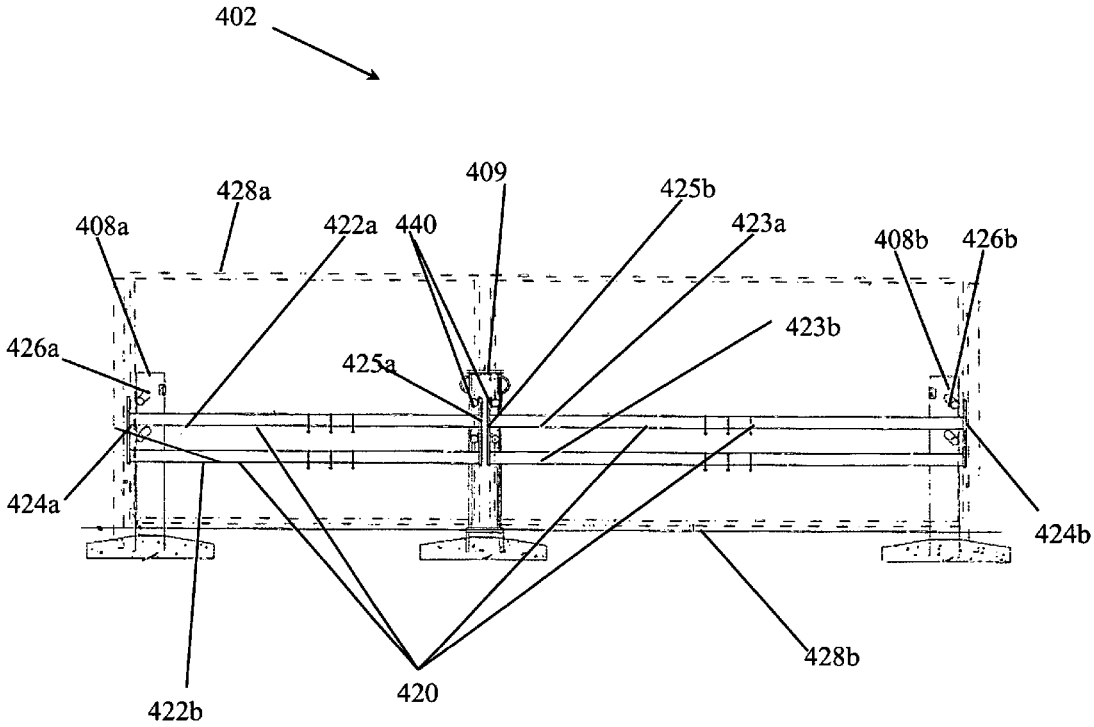
FIG. 11 is a side view of one embodiment of the present invention that includes two double bar crash beams attached to a host two-door gate and at least three superposts that are anchored in the ground.
Figure 12A:
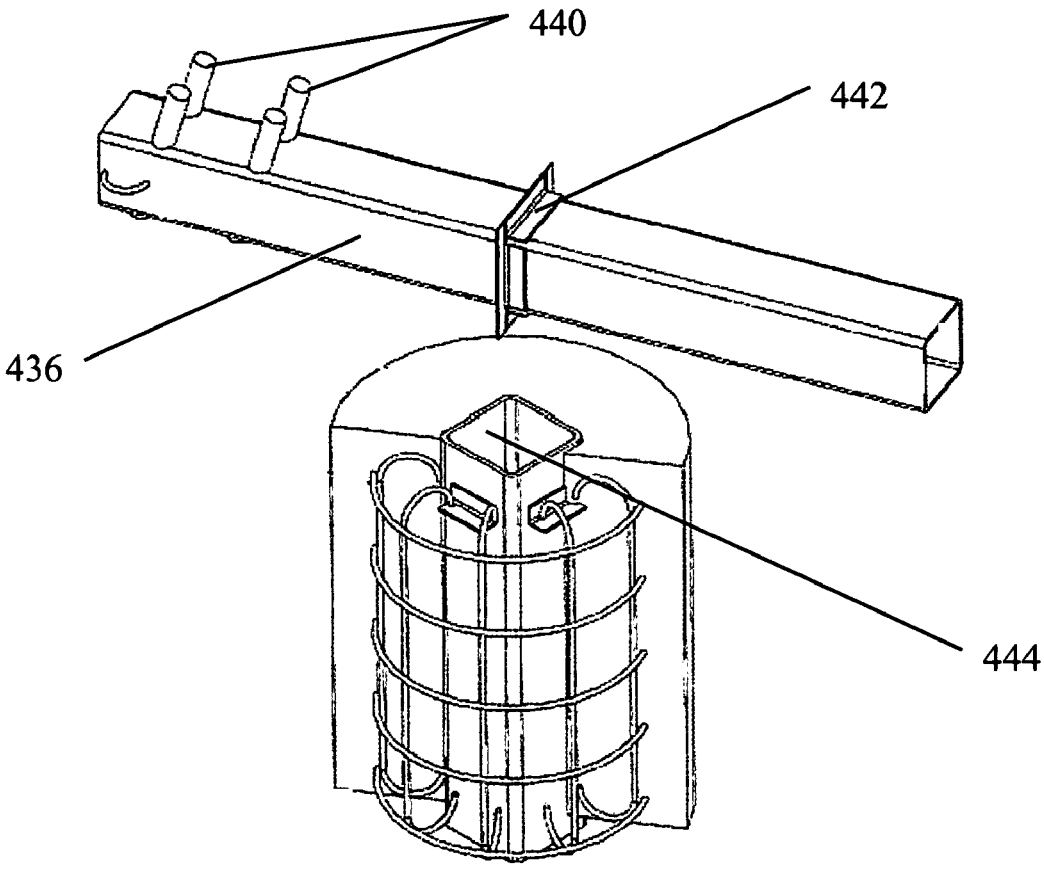
FIG. 12*a* is a view that includes a removable middle superpost lying horizontally next to a substantially fixed superpost receptacle that may be used to house and anchor the middle superpost.
Figure 12B:
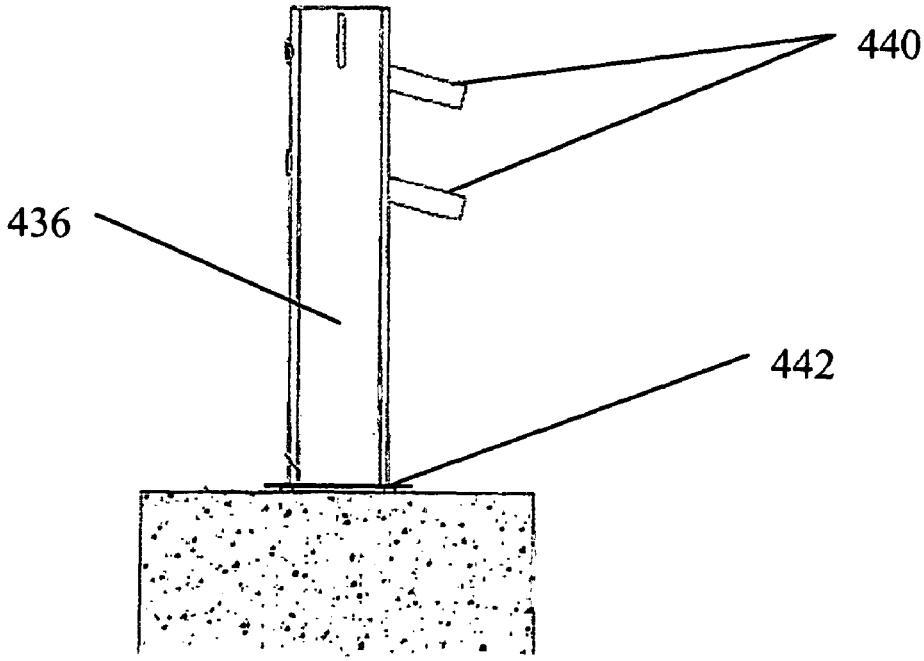
FIG. 12*b* is a side view of a removable middle superpost positioned inside of a substantially fixed superpost receptacle that is used to house and anchor the middle superpost.

The embodiment shown in FIG. 11 includes superposts 408 as in previously discussed embodiments. However, there is an additional member designated as middle superpost 409. As shown in FIGS. 12*a* and 12*b*, middle superpost 409 consists of a pipe 436, preferably polygonal or cylindrical and preferably made of galvanized steel, wherein the greatest cross sectional length within pipe 436 preferably ranges from about ten inches to about twenty inches. The length of middle superpost 409 may vary depending upon the application, but the length shown in FIG. 11 is approximately eight feet. Middle superpost 409 preferably includes at least two, and more preferably four, middle superpost catch horns 440 and a receptacle 444, which are preferably made of galvanized steel. The receptacle 444 is preferably a polygonal or cylindrical pipe structure designed such that middle superpost 409 will fit substantially secure inside the receptacle 444. A catch rim 442 is preferably molded, welded, or otherwise attached to the structure of the middle superpost 409 to prevent debris from entering the receptacle 444. The receptacle design allows for the middle superpost 409 to be selectively removed so that, for example, large vehicles can more easily pass through a protected gate. Receptacle 444 is preferably fixed into a substantially stationary position using metal rebar and concrete cement as shown in FIGS. 12*a* and 12*b*.

As with previously discussed embodiments, the embodiment shown in FIG. 11 contains catch horns 426 on the superposts 408, the catch horns 426 preferably made of galvanized steel. As with previously discussed embodiments, gate portions 428, while in a substantially closed position, are oriented such that the catch horns 426 on the superposts 408 will substantially snare first ends 424 and middle superpost catch horns 440 will substantially snare second ends 425 when an adequate force acts upon attachable assemblies 420 so as to move them into contact with superposts 408 and middle superpost 409.

Figure 13A:
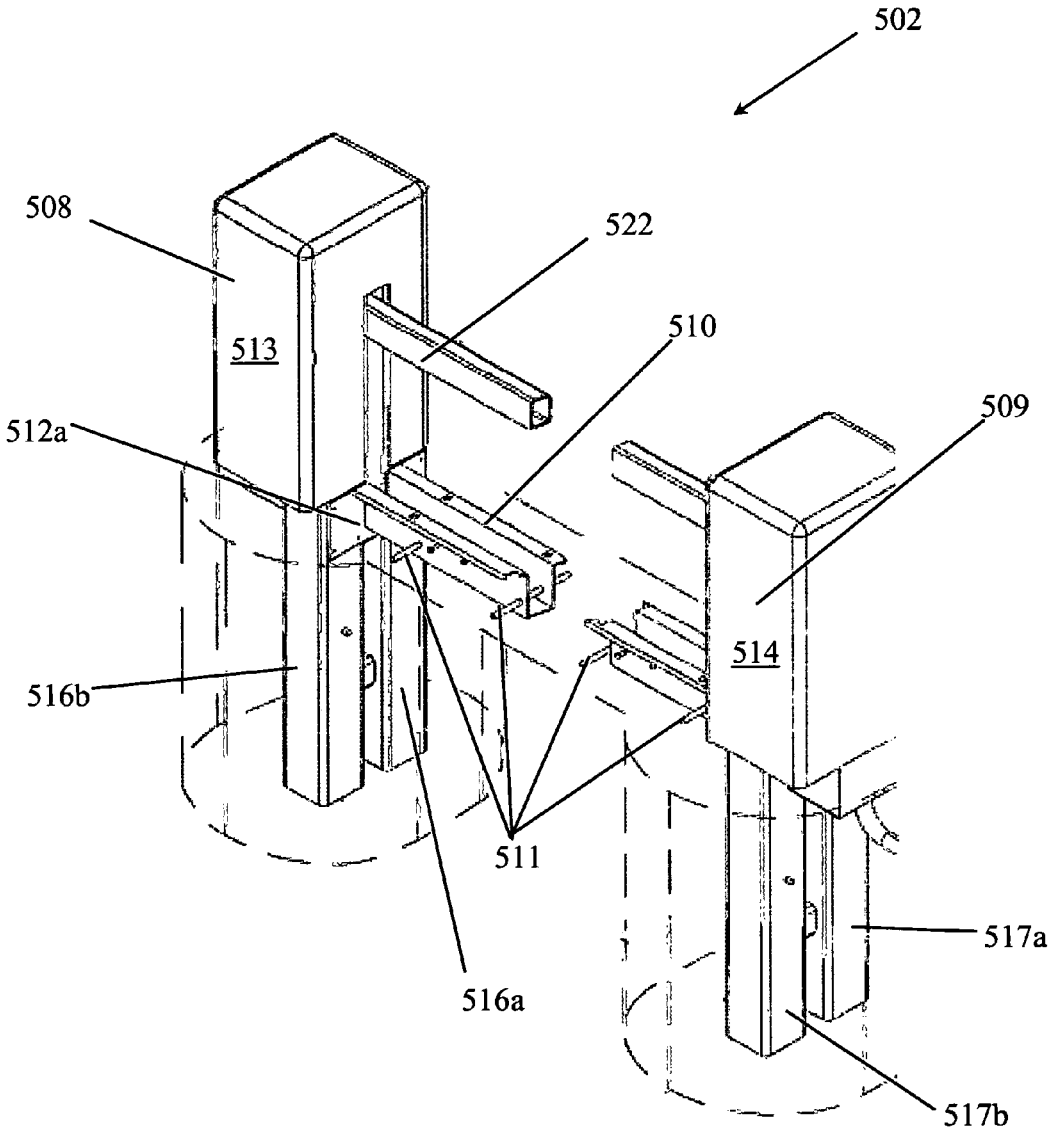
FIG. 13*a* is a view looking down at an angle on one embodiment of the present invention that includes at least two superposts and a crash beam that may be raised and lowered substantially vertically.
Figure 13B:
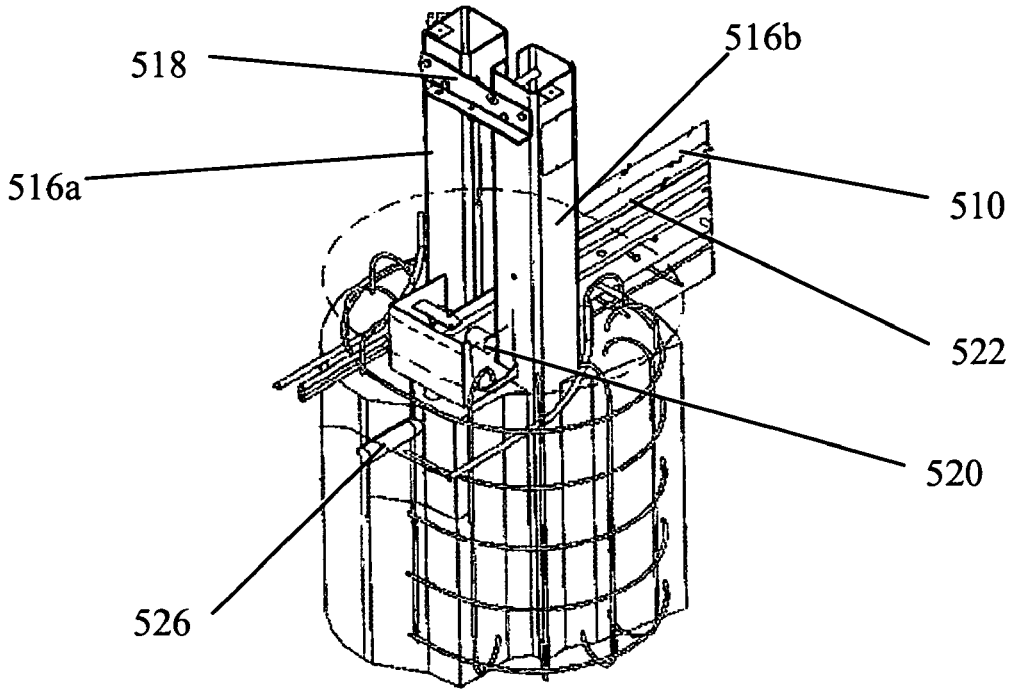
FIG. 13*b* is a detailed cutaway view showing the interior of one of the superposts and attached members in one embodiment of the present invention.
Figure 13C:
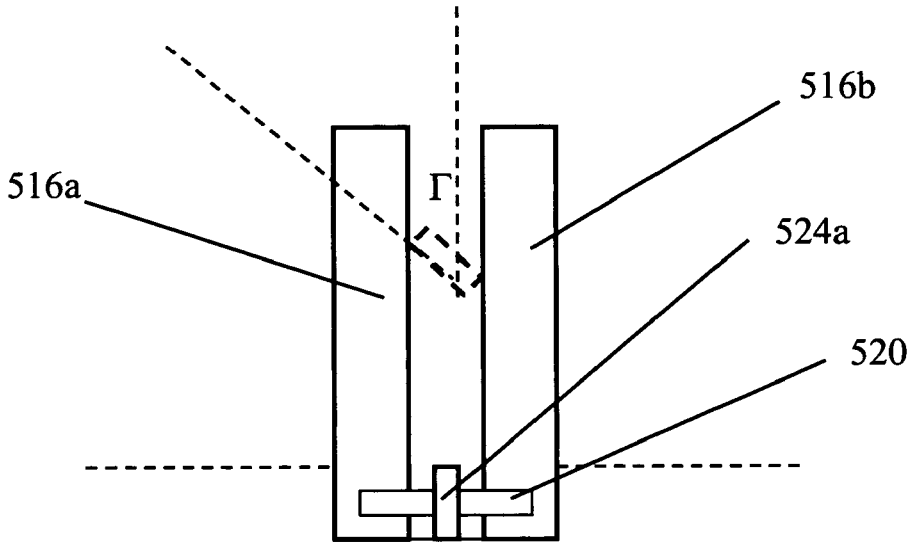
FIG. 13*c* is a side view looking along the axis of a crash beam located between a first and second post inside one of the superposts in one embodiment of the present invention.

FIGS. 13*a*, 13*b*, and 13*c* display an embodiment of the present invention including security barrier apparatus 502 with a first superpost 508 including a first outer shell 513 and a second superpost 509 including a second outer shell 514. First superpost 508 and second superpost 509 are situated on opposing sides of an ingress/egress area. A first end 524*a* of a crash beam 522 is connected to first superpost 508. A second end 524*b* (not shown) of crash beam 522 is connected to second superpost 509. The distance between the first end 524*a* and the second end 524*b* preferably ranges from about ten feet to about forty feet. Crash beam 522 is preferably made of rectangular galvanized steel tubing. One or more cables, preferably made of steel, may be placed within crash beam 522 to increase the durability of the crash beam 522.

A beam well 510 is connected to first superpost 508 at a first beam well end 512*a*; beam well 510 is connected to second superpost 509 at a second beam well end 512*b* (not shown). During operation of the security barrier apparatus 502, the crash beam 522 may be lowered into beam well 510 to substantially conceal crash beam 522, thereby allowing for ingress and egress through the security barrier apparatus 502. Beam well 510 is preferably submerged below ground level as shown in FIG. 13*a* and FIG. 13*c*. Those skilled in the art will appreciate, however, that substantially fixing the beam well 510 below ground level is not the only option because ramps and like simple machines may be used to substantially enclose beam well 510 to allow for ingress and egress through security barrier apparatus 502 when crash beam 502 is substantially concealed within beam well 510. Support pins 511 within the beam well 510 provide support to the crash beam 522 in the lowered position to sufficiently support a vehicle traveling through the security barrier apparatus 502. Support pins 511 also hold the crash beam 522 above rainwater that may collect in the beam well 510, thereby preventing corrosion.

With specific attention drawn to FIG. 13*b*, first superpost 508 is shown without first outer shell 513. First superpost 508 is further broken down into a first superpost first post 516*a* and a first superpost second post 516*b* (hereinafter referred to together as posts 516), wherein posts 516 preferably range from about six feet to about twelve feet in length. Second superpost 509 is similarly broken down into a second superpost first post 517*a* and a second superpost second post 517*b* (hereinafter referred to together as posts 517). Posts 516 and posts 517 are preferably made of galvanized steel. Posts 516 and posts 517 are partially buried in the ground and preferably encased in the ground using an encasing means such as concrete cement. The encasing means is preferably reinforced with metal rebar as shown in FIG. 13*b*. If concrete cement is used, the concrete cement preferably has a minimum of 3,000 psi compressive strength per ASTM C-39. In the preferred embodiment shown in FIG. 13*b*, a drain pipe 526 is situated within the concrete cement matrix before curing to allow for moisture to be removed from the beam well 510. Posts 516 are preferably both attached to a crossbar 518 by an attachment means such as screw, bolt, welding, and other like attachment means known to those skilled in the art. Similarly, posts 517 are both attached to a crossbar (not shown) by an attachment means such as screw, bolt, welding, and other like attachment means known to those skilled in the art. Beam well 510 is attached to posts 516 at beam well end 512*a* and to posts 517 at beam well end 512*b*, preferably by welding.

Crash beam 522 extends between first superpost first post 516*a* and first superpost second post 516*b*; crash beam 522 also extends between second superpost first post 517*a* and second superposts second post 517*b*. As shown in FIG. 13*c*, crash beam 522 preferably has a thickness such that crash beam 522 cannot be rotated at an angle Γ more than about forty-five degrees to about seventy degrees when crash beam 522 is placed between posts 516 and posts 517. A substantially perpendicular member such as first catch horn 520 is attached close to crash beam end 524*a*, preferably by welding, whereby the perpendicular member substantially hinders crash beam end 524*a* from moving past posts 516 in a direction substantially toward crash beam end 524*b* when security barrier apparatus 502 is acted upon by a force such as a moving vehicle. Similarly, a substantially perpendicular member such as second catch horn 521 (not shown) is attached close to crash beam end 524*b*, preferably by welding, whereby the perpendicular member substantially hinders crash beam end 524*b* from moving past posts 517 in a direction substantially toward crash beam end 524*a* when security barrier apparatus 502 is acted upon by a force such as a moving vehicle. In alternate embodiments, the crash horns 520 and 521 may be mechanically connected to the crash beam by inserting the crash horns through sleeves in the crash beam and pinning the crash horns in place.

During operation, crash beam 522 is preferably moved up and down using a lifting means, preferably powered by electricity, such as hoist system (not shown). The lifting means selected for a particular embodiment may operate using a pulley system, a direct pressure system (such as a hydraulic lift), or any other similar powered means known to those skilled in the art capable of moving crash bar 522 into at least two positions. The minimum two positions consist of an "open" position and a "closed" position. The "open" position is a configuration of security barrier apparatus 502 in which crash bar 522 is substantially concealed by beam well 510 so that ingress and egress through security barrier apparatus 502 is facilitated. The "closed" position is a configuration of security barrier apparatus 502 in which crash bar 522 is raised to a substantially equivalent height between posts 517 and 518 of first superpost 508 and second superpost 509 so that ingress and egress through security barrier apparatus 502 is physically discouraged. The hoist system is preferably an electrical hoist system. In one embodiment, a counterweight system may be installed within a post and may be connected to the hoist system to move the crash beam 522 to a "closed" position upon a power failure.

Figure 14A:
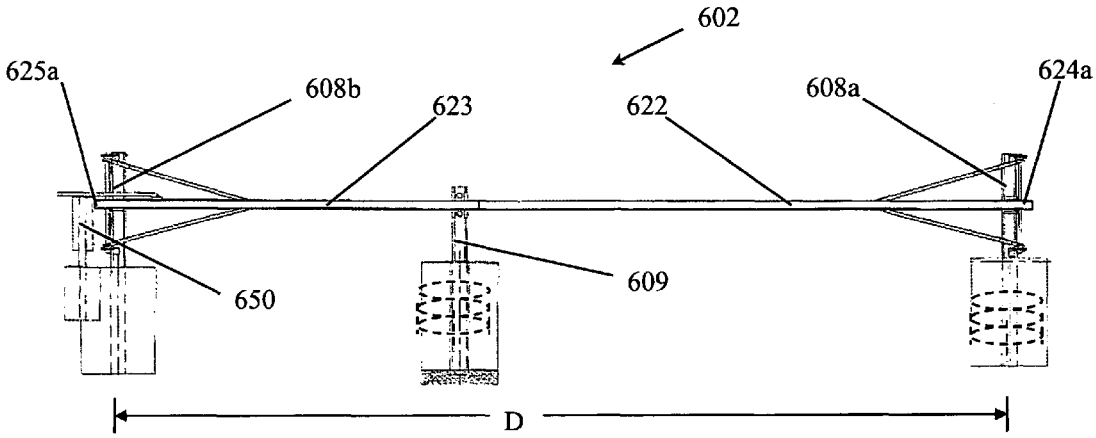
FIG. 14*a* is a side view of one embodiment of the present invention that contains at least two rotatable crash beams, at least one middle superpost, and at least two superposts.
Figure 14B:
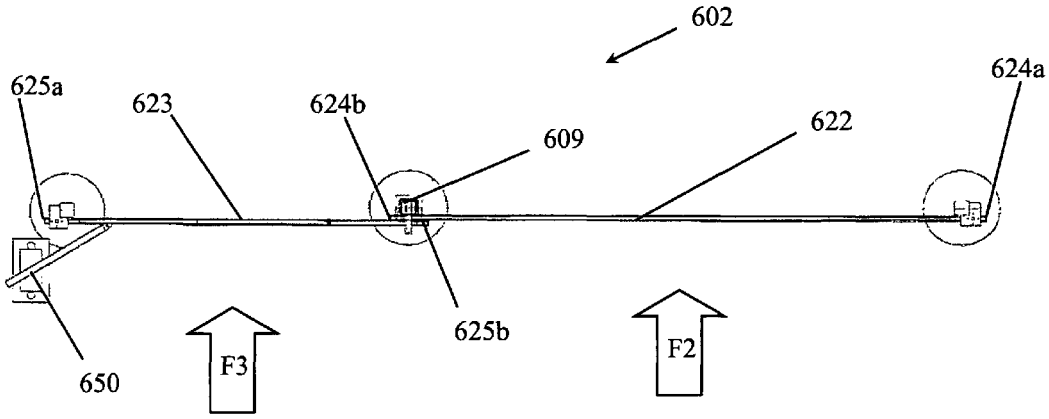
FIG. 14*b* is a view looking down on one embodiment of the present invention that contains at least two rotatable crash beams, at least one middle superpost, and at least two side superposts.
Figure 14C:
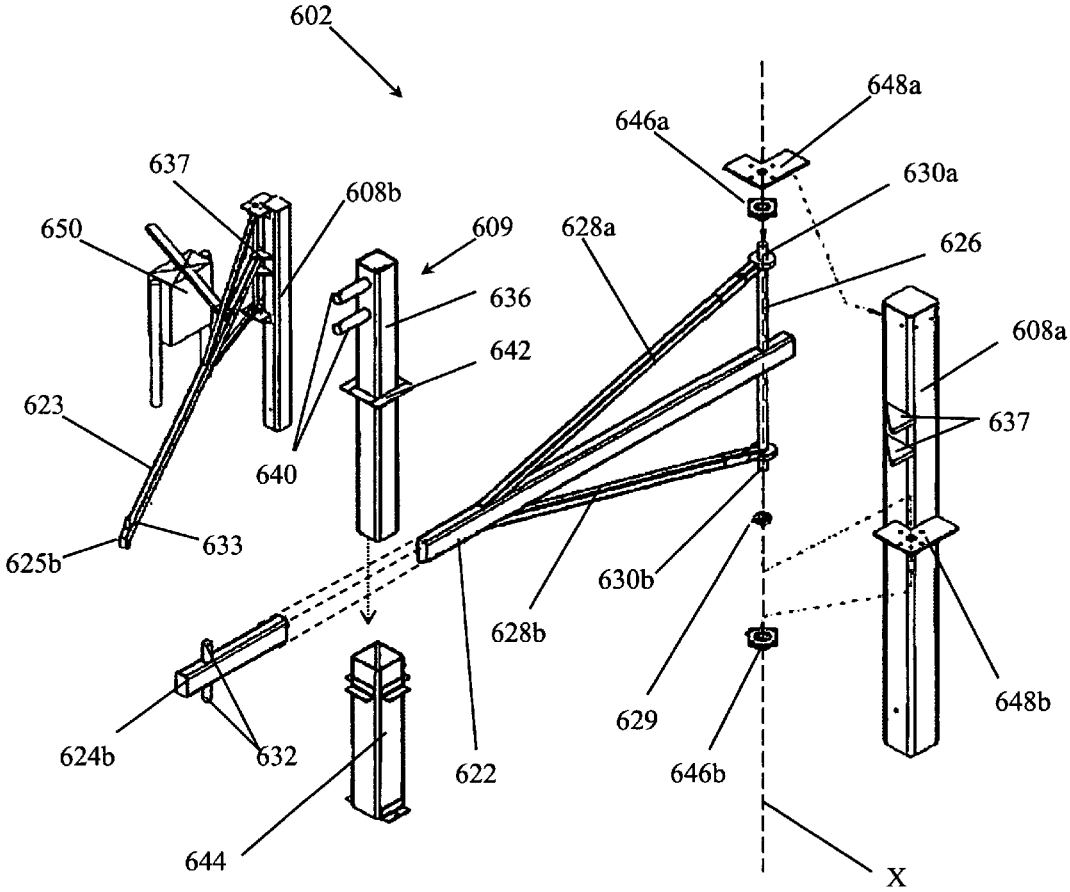
FIG. 14*c* is an exploded view of one embodiment of the present invention that contains at least two rotatable crash beams, at least one middle superpost, and at least two side superposts.

FIGS. 14*a*, 14*b*, and 14*c* display an embodiment including security barrier apparatus 602 with a first superpost 608*a*, a second superpost 608*b*, and a middle superpost 609. First and second superposts 608*a* and 608*b* (hereinafter referred to together as superposts 608) are situated on opposing sides of an ingress/egress area. The distance D between superposts 608 preferably ranges from about fifteen feet to about fifty feet. A first end 624*a* of a first crash beam 622 is connected to first superpost 608*a*. A first end 625*a* of a second crash beam 623 is connected to second superpost 608*b*. Crash beams 622 and 623 are preferably made of rectangular galvanized steel tubing. One or more cables, preferably made of steel, may be placed within crash beams 622 and 623 to increase the durability of the crash beams 622 and 623.

First end 624*a* preferably includes a hinge pin 626 substantially perpendicular to crash beam 622. Hinge pin 626 is preferably a solid steel bar that is attached to crash beam 622, preferably by welding techniques known to those skilled in the art. An upper support brace 628*a* and a lower support brace 628*b* are preferably attached to both crash beam 622 and pole 626 as shown in FIG. 14*c* to offer static structural support to crash beam 622. As shown in FIG. 14*c*, upper pole tip 630*a* is preferably slotted through an upper radial bearing 646*a* and into upper radial plate 648*a*. Upper radial plate 648*a* is preferably attached to first superpost 608*a* by welding, bolting, or other similar attachment methods known to those skilled in the art. Similarly, lower pole tip 630*b* is preferably slotted through a thrust bearing 629, lower radial bearing 646*b*, and into lower radial plate 648*b*. Lower radial plate 648*b* is preferably attached to first superpost 608*a* by welding, bolting, or other similar attachment methods known to those skilled in the art. The preferable attachment mechanisms between crash beam 622 and first superpost 608*a* allows for crash beam to rotate about an axis X defined by pole 626. The attachment between crash beam 623 and second superpost 608*b* is preferably accomplished in like manner to the description just given for the attachment between crash beam 622 and superpost 608*a*. It should be understood, however, that other suitable means of attaching crash bars 622 and 623 to superposts 608*a* and 608*b* may be used. Such other means may not require specific members described herein such as the use of support braces or radial bearings.

Middle superpost 609 includes a pipe 636, preferably polygonal or cylindrical and preferably made of galvanized steel, wherein the greatest diameter within pipe 636 ranges from between about eight inches to about twenty inches. The length of middle superpost 609 may vary depending upon the application, but the length shown in FIGS. 14*a* and 14*c* is approximately eight feet. Middle superpost 609 preferably includes at least two middle superpost catch horns 640 and a receptacle 644, both of which are preferably made of galvanized steel. Catch horns 640 are preferably made of metallic round stock such as steel round stock ranging in diameter from between about 2 inches to about 4 inches. Catch horns 640 are preferably welded to middle superpost 609; however, other means of attachment may be used including, but not limited to, creating the catch horns and pipe as one structure via a metallic molding process. The receptacle 644 is preferably a polygonal or cylindrical pipe structure designed such that middle superpost 609 will fit substantially secure inside the receptacle 644. A catch rim 642 is preferably molded or attached to the structure of the middle superpost 609 to prevent debris from entering the receptable 644. The receptacle design allows for the middle superpost 609 to be selectively removed so that, for example, large vehicles can more easily pass through a protected gate. Receptacle 644 is preferably fixed into a substantially stationary position using metal rebar and concrete cement as shown in FIG. 14*a*.

Two positions of reference for security barrier apparatus 602 are hereby defined wherein an "open" position is a configuration of security barrier apparatus 602 in which crash beams 622 and 623 are substantially parallel with the ingress/egress area (i.e., a roadway). In contrast, a "closed" position is defined as a configuration of security barrier apparatus 602 in which crash beams 622 and 623 are substantially perpendicular with the ingress/egress area, physically discouraging travel along the ingress/egress area. Crash beam 622 has a length longer than the distance between first superpost 608*a* and the middle superpost 609 so that crash beam 622 firmly contacts and is inhibited by middle superpost 609 when crash beam 622 is rotated to a substantially "closed" position. Similarly, crash beam 623 has a length longer than the distance between second superpost 608*b* and the middle superpost 609 so that crash beam 623 firmly contacts and is inhibited by middle superpost 609 when crash beam 623 is rotated to a substantially "closed" position. Both crash beams 622 and 623 open outwardly in the direction facing the area unprotected by the security barrier apparatus 602.

Crash beam 622 contains at least one catch bar 632 near the second end 624*b* of crash beam 622. Similarly, crash beam 623 contains at least one catch bar 633 near the second end 625*b* of crash beam 623. As shown in FIGS. 14*a* and 14*b*, catch bar 632 is situated along crash bar 622 so as to catch against the catch horns 640 if an adequate force F2 were to act upon crash beam 622. Similarly, catch bar 633 is situated along crash beam 623 so as to catch against the substantially perpendicular catch horns 640 if an adequate force F3 were to act upon crash beam 623.

Further, first and second superposts 608 include retention brackets 637 situated along the superposts 608 so that crash beams 622 and 623 are located between two retention brackets 637 in the "closed" position. The retention brackets 637 limit vertical movement of the crash beams 622 and 623 when impacted with a force. Further, the hingepins 626 are snared by the retention brackets 637 when the crash beams 622 and 623 are impacted by a force.

An electrically powered drive operator 650 is preferably used to move at least one of the crash beams 622 and 623. Such a drive operator as drive operator 650 is not necessary, however, because the security barrier apparatus 602 may be operated manually.

In alternate embodiments, security barrier apparatus 602 may be a single entrance barrier apparatus and may not include second superpost 608*b* and crash beam 623.

Figure 15A:
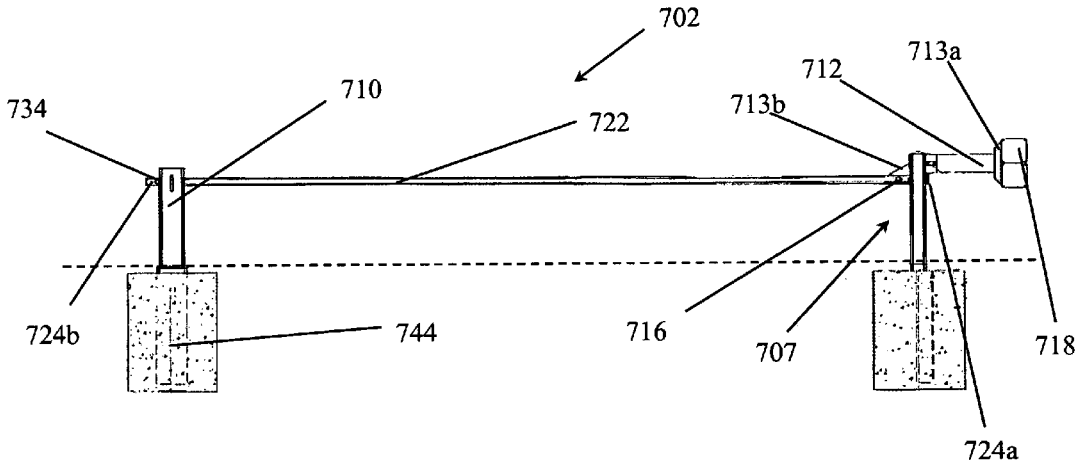
FIG. 15*a* is a side view of one embodiment of the present invention that includes a crash beam that may be selectively raised and lowered from one end of the crash beam.
Figure 15B:
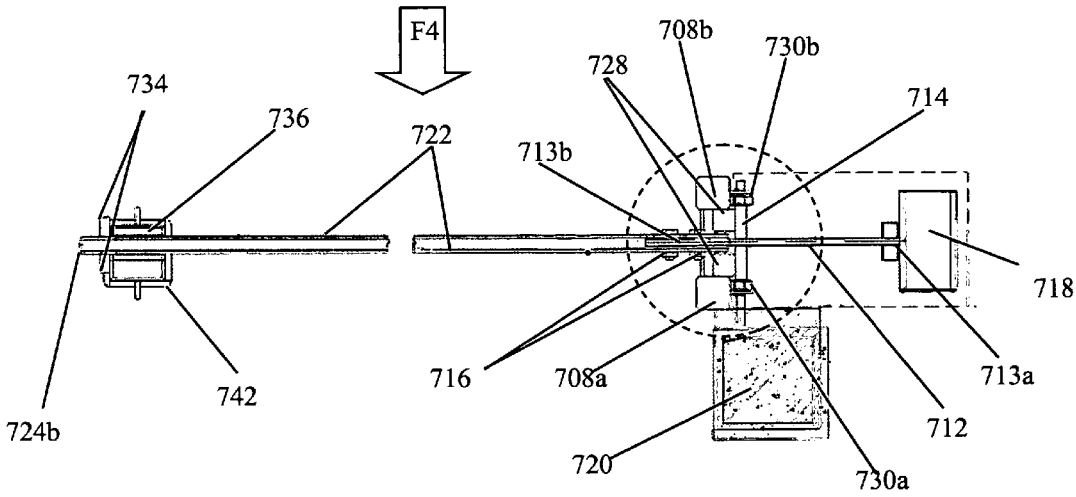
FIG. 15*b* is a view looking down on one embodiment of the present invention that includes a crash beam that may be selectively raised and lowered from one end of the crash beam.
Figure 15C:
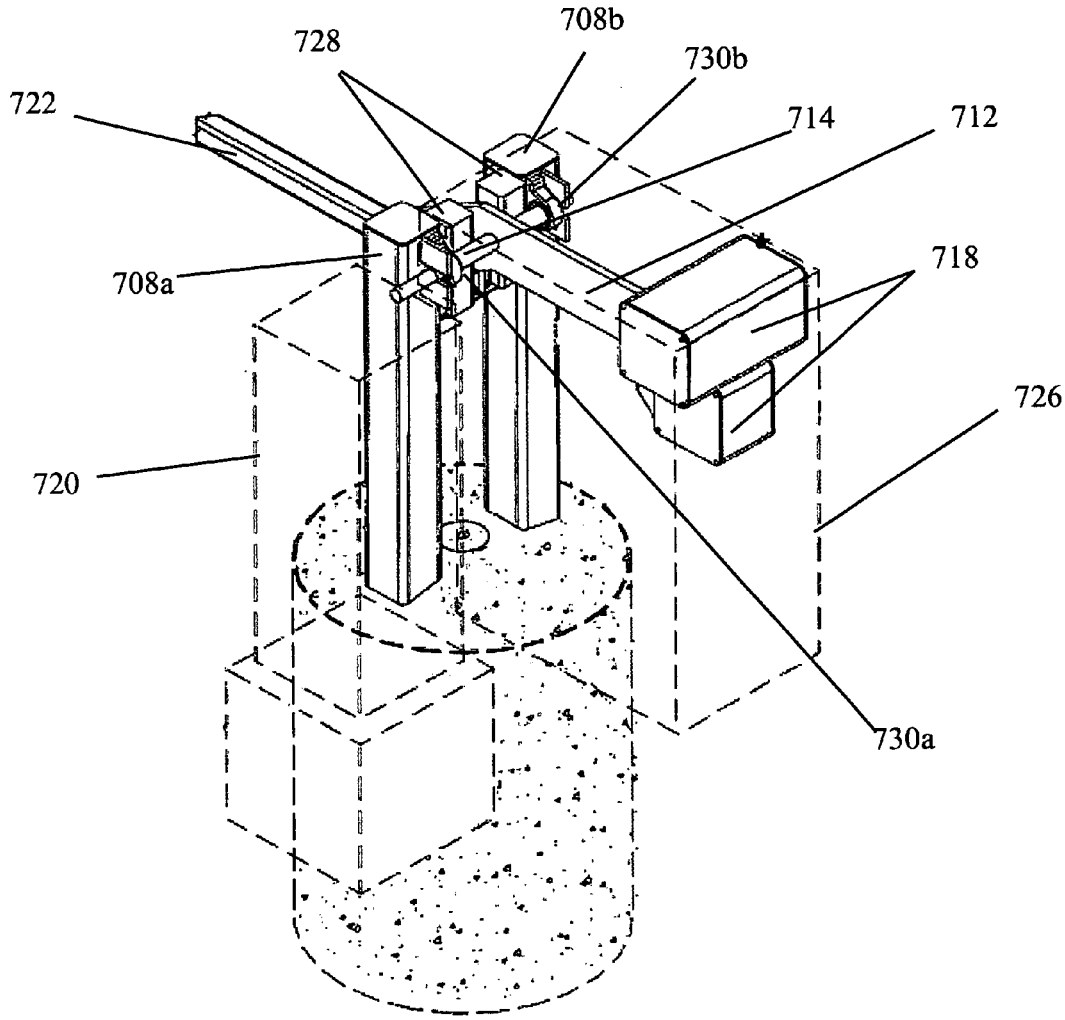
FIG. 15*c* is a detailed view looking down at an angle at one end of one embodiment of the present invention that includes a crash beam that may be selectively raised and lowered from one end of the crash beam.

Another embodiment of the invention is shown in FIGS. 15*a*, 15*b*, and 15*c*.

FIG. 15*a* shows a side view of security barrier apparatus 502 with a pivot superpost 707 having a first pivot post 708*a* and a second pivot post 708*b*, a receiver superpost 710, a crash beam 722, an extension member 712, and a counterweight assembly 718. Crash beam 722 has a first end 724*a* and second end 724*b* (hereinafter referred to together as ends 724).

First pivot post 708*a* and second pivot post 708*b* (hereinafter referred to together as pivot posts 708) as well as receiver superpost 710 are preferably polygonal or cylindrical pipes preferably made of galvanized steel. Pivot superpost 707 and receiver superpost 710 preferably range in length from about six feet to about twelve feet. The inside cross sectional length of each pivot post 708 preferably ranges from about four inches to about ten inches. The inside cross sectional length of receiver superpost 710 preferably ranges from about eight inches to about twenty inches. Pivot posts 708 are preferably substantially fixed by encasing about half the length of pivot posts with a fixing agent such as concrete cement as shown in FIGS. 15*a* and 15*c*. In a preferred embodiment, the fixing agent is reinforced with metal rebar, preferably made of steel. Receiver superpost 710 is preferably placed in a substantially fixed position by first substantially encasing a receptacle 744 in a fixing agent such as concrete cement. The receptacle 744 is preferably made of galvanized steel polygonal or cylindrical pipe such that receiver superpost 710 will fit substantially securely within receptacle 744 when receiver superpost 710 is partially inserted into receptacle 744. A catch rim 742 is preferably molded, welded, or otherwise attached to the structure of the receiver superpost 710 to prevent debris from entering into the receptacle 744. The receptable allows for receiver superpost 710 to be easily removed and replaced. However, it should be understood that there are many ways to substantially fix receiver post 710 into an operable position for use with security barrier apparatus 702. Crash beam 722 is preferably a polygonal pipe preferably made of galvanized steel with a length preferably ranging from about ten feet to about thirty-six feet. A cable may be inserted through the interior of the crash beam 722 to reinforce the strength of the beam 722.

Extension member 712 has a first end 713*a* and a second end 713*b* (hereinafter referred to together as ends 713) whereon counterweight assembly 718 is attached to the first end 713*a* by welding, bolt assembly, or other attachment means known to those skilled in the art. Crash beam 722 is preferably attached to second end 713*b* by a bolt assembly such as bolt assembly 716. A pivot shaft 714 is attached to or through extension member 712, preferably by welding, as shown in FIGS. 15*b* and 15*c*. Pivot shaft 714 is held substantially fixed on its axis adjacent to pivot posts 708 by a fixation means such as a set of collars like first collar 730*a* and second collar 730*b* (hereinafter referred to together as collars 730). Collars 730 are attached to pivot posts 708 preferably by bolt assembly, welding, or other similar attachment means known to those skilled in the art. The motion associated with counterweight assembly 718 is preferably covered by a counterweight cover 726 for increased safety.

During operation of security barrier apparatus 702, the crash beam 722 may be moved by rotating the extension member 712 about the axis defined by the longest central axis of pivot shaft 714. Pillow blocks 728 are preferably situated between pivot posts 708 and crash beam 722 as shown in FIGS. 15*b* and 15*c*. When extension member 712 is rotated such that crash beam 722 is raised into the air up to a substantially ninety-degree position relative to the ingress/egress area, the security barrier apparatus configuration is hereby defined as "open." In contrast, when crash beam 722 is at rest while in contact with receiver superpost 710, the configuration of security barrier apparatus is defined as "closed." Security barrier apparatus 702 may be operated manually, but operation is preferably accomplished using an artificial power source such as electro-hydraulic operator 720.

A receiver superpost channel 736 is preferably formed at the top of receiver superpost 710 to provide a more stable rest area for crash bar 722 when it is in the closed position and to provide part of a passive locking mechanism when an adequate force contacts crash beam 722. A catch horn 734 is attached substantially near the second end 724*b* of crash bar 722. If security barrier apparatus 702 is struck with an adequate force like force F4 along crash beam 722, crash beam 722 will tend to pull both ends 724 toward the point of contact with force F4. Catch horns 734 will provide resistance to this motion due to its straddled position 25 about receiver channel 736 as shown in FIG. 15*b*. Similarly, pivot shaft 714 is located on the far side of pivot posts 708 relative to a force acting on crash beam 722, thereby providing resistance to any motion of crash beam 722 toward receiver superpost 710.

Another embodiment of the invention, security gate apparatus 802, is displayed in FIGS. 16*a*, 16*b*, 16*c*, 16*d*, 16*e*, and 16*f*. Security gate apparatus 802 is preferably an upgrade or addition to a previously existing gate structure; however, a new gate system with at least one sliding gate may be built for the specific purpose of accommodating security gate apparatus 802.

Figure 16A:
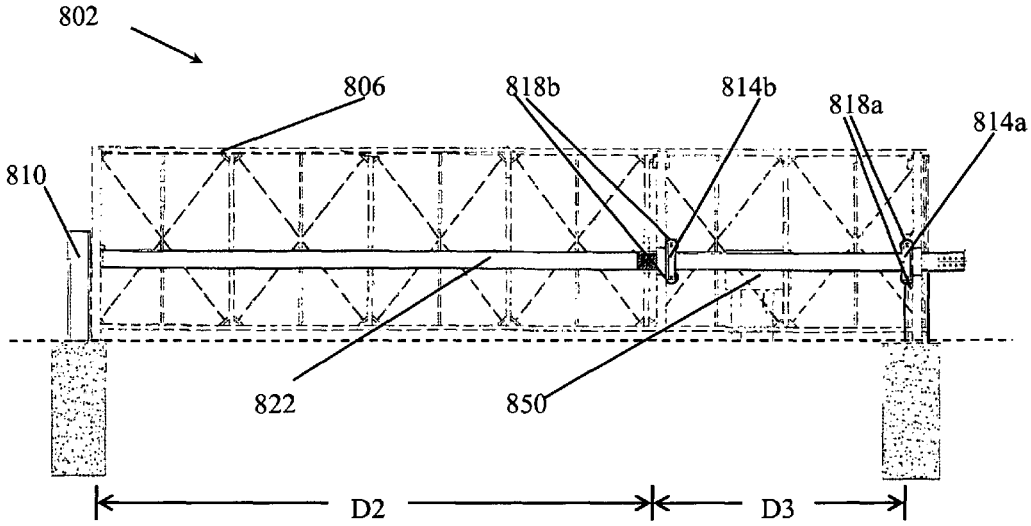
FIG. 16*a* is a side view of one embodiment of the present invention that includes a crash beam attached to a sliding gate and at least two superposts.
Figure 16B:
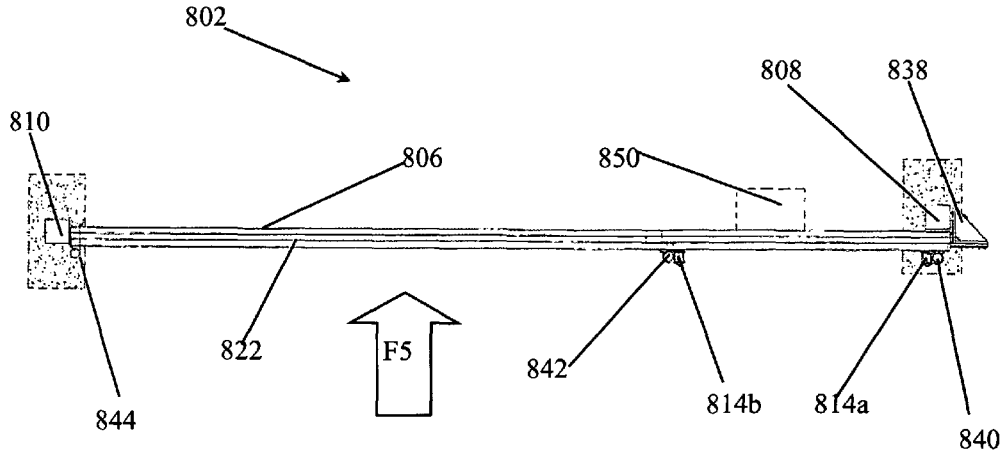
FIG. 16*b* is a vertical view looking directly down at one embodiment of the present invention that includes a crash beam attached to a sliding gate and at least two superposts.
Figure 16C:
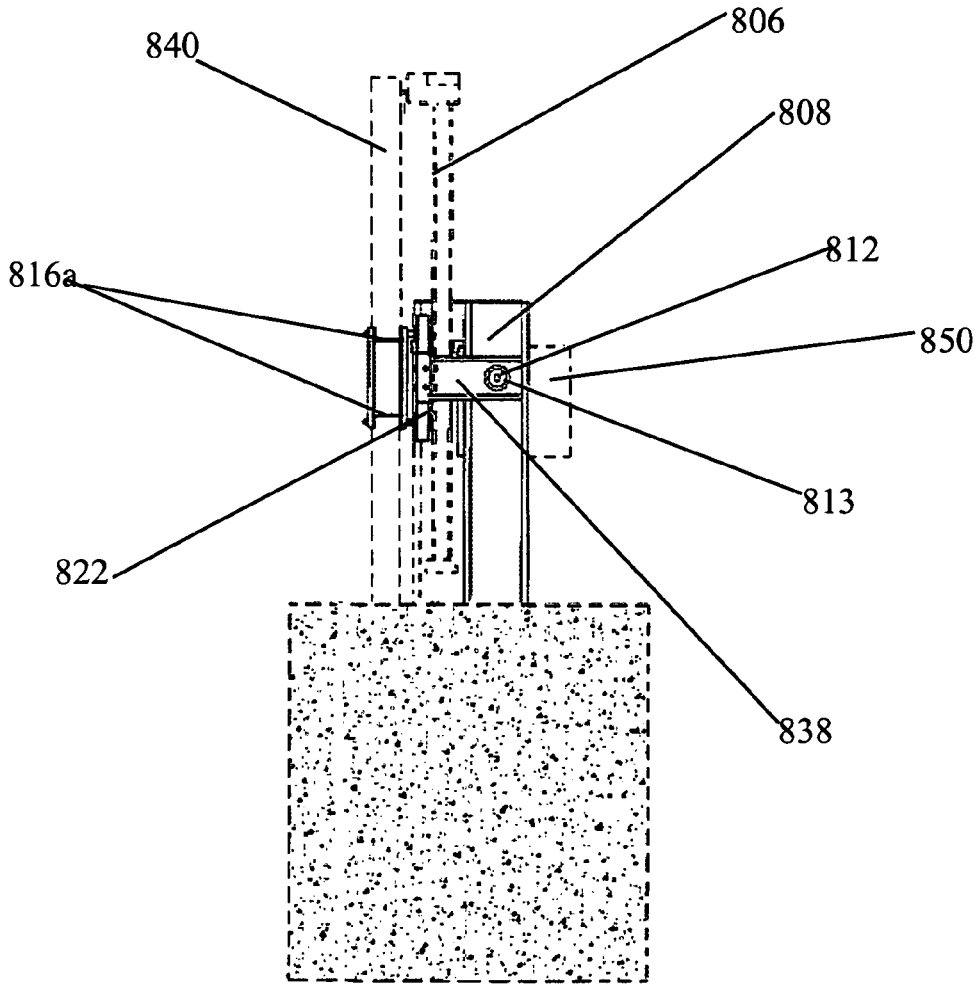
FIG. 16*c* is a side view of one embodiment of the present invention looking along the axis of a crash beam that is attached to a sliding gate and selectively placed between at least two superposts.
Figure 16D:
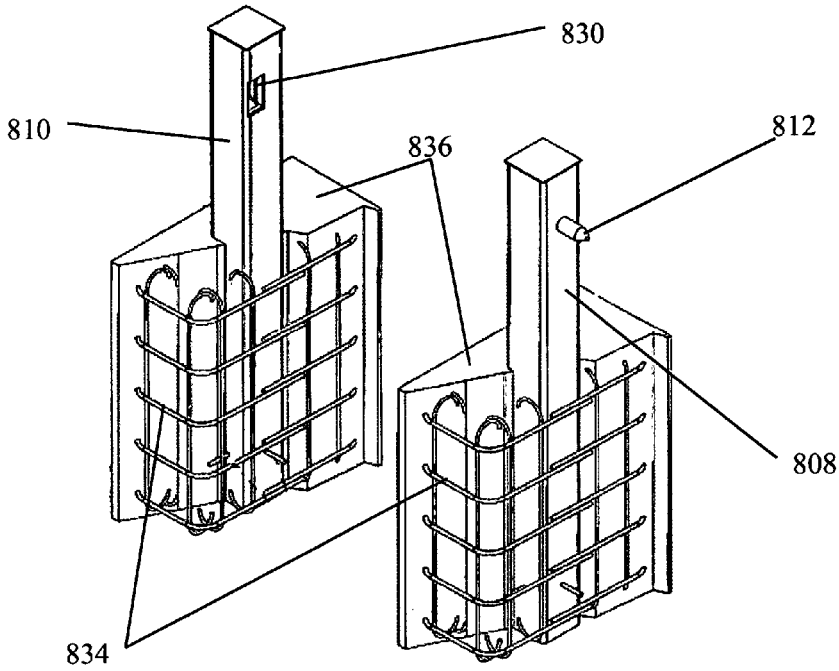
FIG. 16*d* is a view looking down at an angle at a receiver superpost assembly on the left and an operator superpost assembly on the right, including a cutaway view on concrete cement anchoring with metal rebar reinforcement.
Figure 16E:
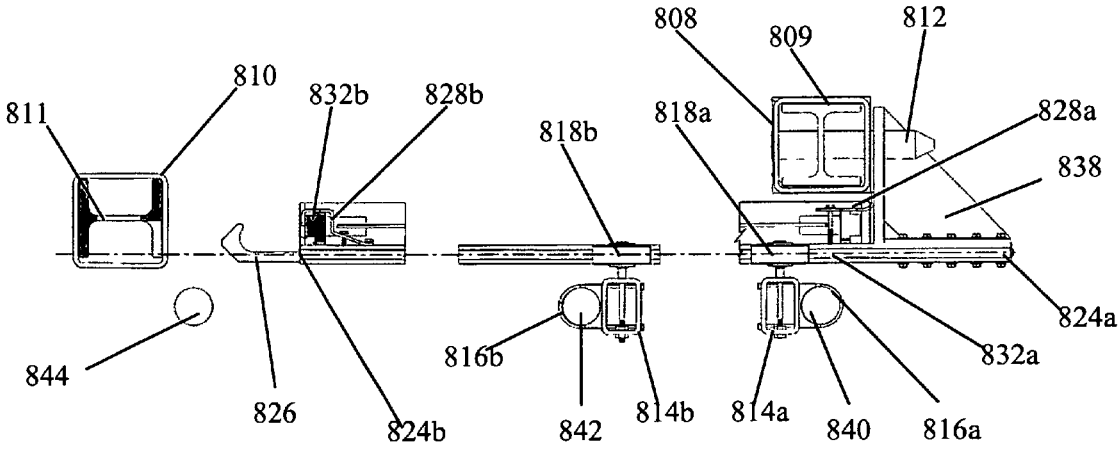
FIG. 16*e* is a vertical cutaway view of the top of specific parts of one embodiment of the present invention, including the receiver superpost assembly, the operator superpost assembly, the crash bar, the crash bar ends, and support members.
Figure 16F:
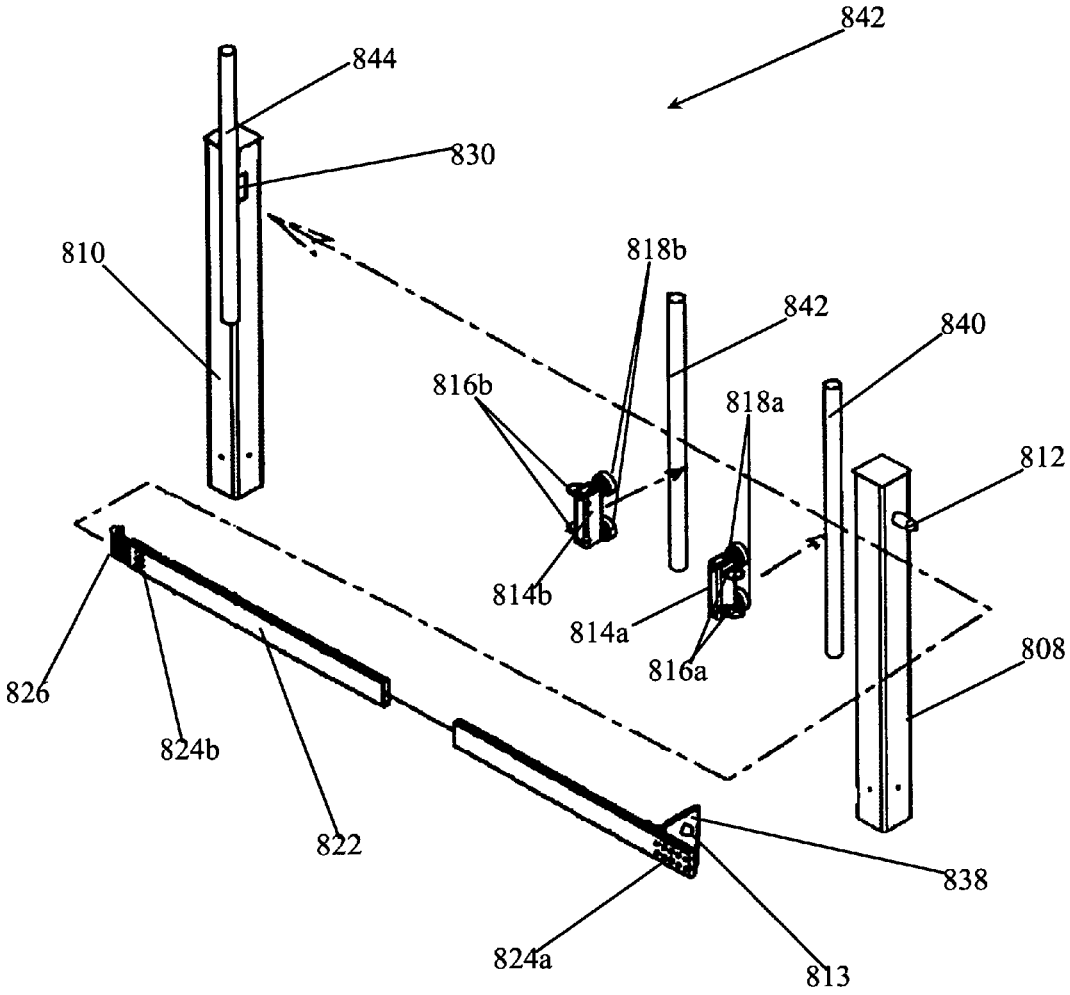
FIG. 16*f* is an exploded view on one embodiment of the present invention that includes a crash beam attached to a sliding gate and at least two superposts.

After a host gate is selected for mounting security gate apparatus 802, an operator superpost 808 and a receiver superpost 810 are substantially fixed in the ground at specified locations preferably using concrete cement 836 with a metal rebar assembly 834 for reinforcement as shown in FIG. 16*d*. The security gate apparatus 802 may be installed on either the ingress or egress side of a host gate. FIG. 16*f* shows an exploded view of some of the components in this embodiment including operator superpost 808, receiver superpost 810, a first support member 814*a*, a second support member 814*b*, and a crash beam 822. Crash beam 822 includes a first end 824*a* and a second end 824*b* (hereinafter referred to together as ends 824). FIGS. 16*b*, 16*e*, and 16*f* also show some parts of a host gate structure in a preferred embodiment including a first host gate post 840, a second host gate post 842, and a third host gate post 844, all of which are substantially fixed into the ground.

Receiver superpost 810 is substantially fixed relative to third host gate post 844 as shown in FIG. 16*b* and FIG. 16*e*. Similarly, operator superpost 808 is substantially fixed relative to first host gate post 840 as shown in FIG. 16*b* and FIG. 16*e*. As shown in FIG. 16*a*, the distance D2 between third host gate post 844 and second host gate post 842 preferably ranges from about ten feet to about thirty-six feet. The distance D3 between second host gate post 842 and first host gate post 840 preferably ranges from about three feet to about twelve feet.

Operator superpost 808 and receiver superpost 810 are preferably made of polygonal or cylindrical galvanized steel tubing. Both operator superpost 808 and receiver superpost 810 are preferably between about eight feet to about twelve feet long with preferably about four feet above ground after installation of each. In a particular preferred embodiment as shown in FIG. 16*e*, an operator I-beam 809 is located within operator superpost 808 and a receiver I-beam 811 is located within receiver superpost 810. Operator I-beam 809 and receiver I-beam 811 are both preferably made from steel and have dimensions of about W8×58×96. A horn 812 is preferably attached to operator superpost 808 and operator I-beam 809, preferably by welding. The horn 812 is preferably made of three inch diameter solid steel round stock with a tapered end as shown in FIG. 16*e*. During construction of operator superpost 808, horn 812 is attached to operator superpost 808 preferably by insertion through a pair of fabricated openings (not shown) on either side of superpost 808 and through a second fabricated opening (not shown) on operator I-beam 809. After being inserted through the openings, horn 812 is preferably welded into position.

Crash beam 822 is preferably attached to a host gate member 806 by ties, bolts, clamps, welding, or other similar attachment means known to those skilled in the art. A preferred attachment means shown in FIG. 16*e* includes a mounting clip 828*b* bolted to crash beam 822 toward end 824*b* such that the mounting clip 828*b* is substantially secured to a second host gate end 824*b*. Similarly, mounting clip 828*a* is preferably bolted to crash beam 822 toward end 824*a* such that first host gate end 832*a* is substantially secured to crash beam 822. Crash beam 822 is preferably attached to host moveable gate member such that the centerline of crash beam 822 is situated from between about thirty-two inches to about forty inches above the ground. Crash beam 822 is preferably made from polygonal steel tubing with a length ranging from between about ten feet to about thirty-six feet. However, those skilled in the art appreciate that other metals or metal alloys may be used for the crash beam and other structures in this and all other embodiments described herein. Cable such as steel cable (not shown) may be inserted through the interior of crash beam 822 to reinforce the strength of crash beam 822.

As shown in FIG. 16*e* and FIG. 16*f*, a tenon 826 is attached to the second end 824*b* of crash beam 822. As shown in FIG. 16*d* and FIG. 16*f*, tenon 826 may be inserted within receiver superpost 810 through a tenon receptacle 830. Referring back to FIG. 16*e* and FIG. 16*f*, an hasp 838 is attached to the first end of crash beam 822 by bolts. However, other attachment means may used such as clamps, welding, or other similar means known to those skilled in the art. Hasp 838 includes at least one horn opening 813 through which horn 812 is inserted when security gate apparatus 802 is in a substantially closed position.

FIG. 16*e* and FIG. 16*f* show a support body with various members including first support member 814*a* attached to first host gate post 840. Similarly, a second support member 814*b* is shown attached to second host gate post 842. First support member 814*a* and second support member 814*b* (hereinafter referred to together as support members 814) are preferably attached by attachment members such as a first clamp set 816*a* and a second clamp set 816*b*, respectively. However, other attachment means known to those skilled in the art such as ties, bolts, or vices may used. First support member 814*a* is attached to crash beam 822 by first support rollers 818*a*. Similarly, second support member 814*b* is attached to crash beam 822 by second support rollers 818*b*. First support rollers 818*a* and second support rollers 818*b* (hereinafter referred to together as support rollers 818) allow for crash beam 822 to freely move in a direction substantially perpendicular to first host gate post 840 and second host gate post 842 while substantially supporting the weight of crash beam 822. FIG. 16*c* shows a side view looking at end 824*a* of crash bar 822 where horn 812 is shown protruding through horn opening 813 and first support member 814*a* is shown attached to moveable gate member 806 by first clamp set 816*a*.

When an adequate force such as force F5 shown in FIG. 16*b* strikes the unprotected side of security barrier apparatus 802, crash beam 822 moves and bends in the direction of force F5 pulling ends 824 closer to one another and towards a secure side of the gate. When this happens, tenon 826 passively snares the I-beam 809 and horn 812 snares the hasp 838. The fastening events just described transfer force F5 along receiver superpost 810 and operator superpost 808 down to the anchoring portions of each superpost, thereby preventing the vehicle from entering any areas protected by security barrier apparatus 802.

An electrically powered drive operator 850 is preferably used to move the moveable host gate member 806 with crash beam 822 attached thereto. Such a drive operator as drive operator 850 is not necessary, however, because the security barrier apparatus 802 may be operated manually.

FIGS. 17*a*, 17*b*, 17*c*, 17*d*, 17*e*, and 17*f* display security barrier apparatus 902, another preferred embodiment of the invention described herein. Security barrier apparatus 902 includes a receiver superpost 914, an operator superpost assembly 908, a crash gate 918, and, preferably, a gate track 920. In this embodiment, the crash gate 918 is meant to travel along gate track 920 when driven by an operating means, preferably a 208 volt, three phase electric motor drive such as drive operator 950. An electric motor drive is not necessary however, and any other drive means known to those skilled in the art may be used such as manual drive means, hydraulic drive means, and air pressure drive means.

Figure 17A:
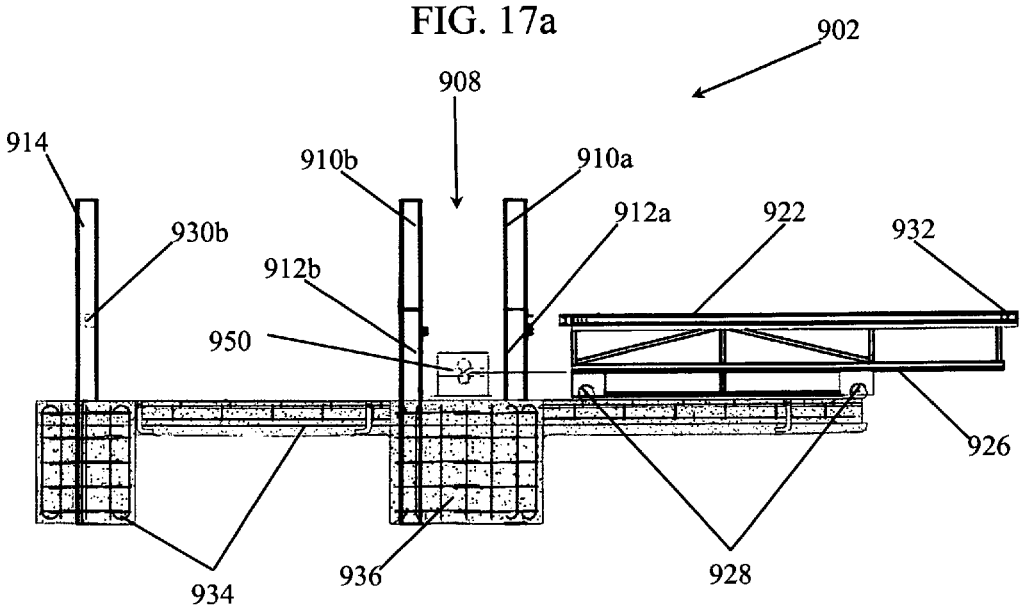
FIG. 17*a* is a side view of one embodiment of the present invention that includes a receiver superpost assembly, an operator superpost assembly, a crash gate assembly, and a gate track assembly.
Figure 17B:
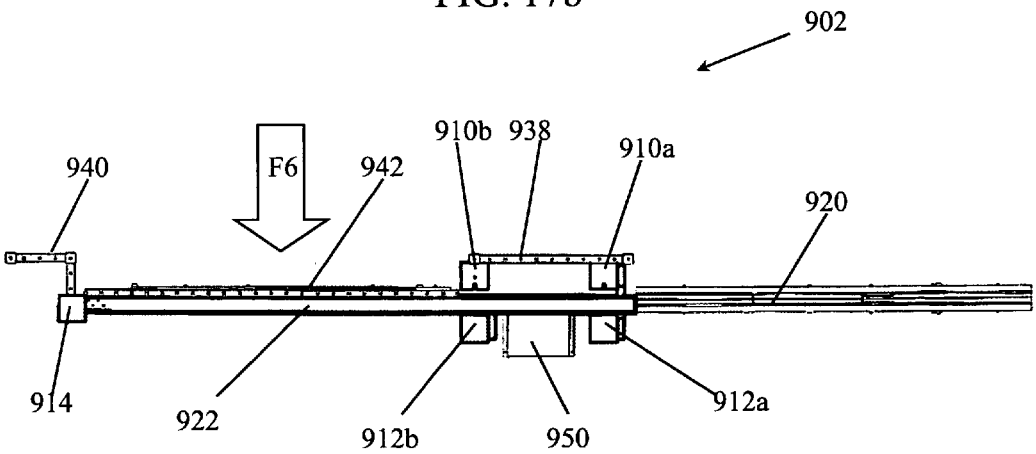
FIG. 17*b* is a vertical view looking directly down at an embodiment of the present invention that includes a receiver superpost assembly, an operator superpost assembly, a crash gate assembly, and a gate track assembly.
Figure 17C:
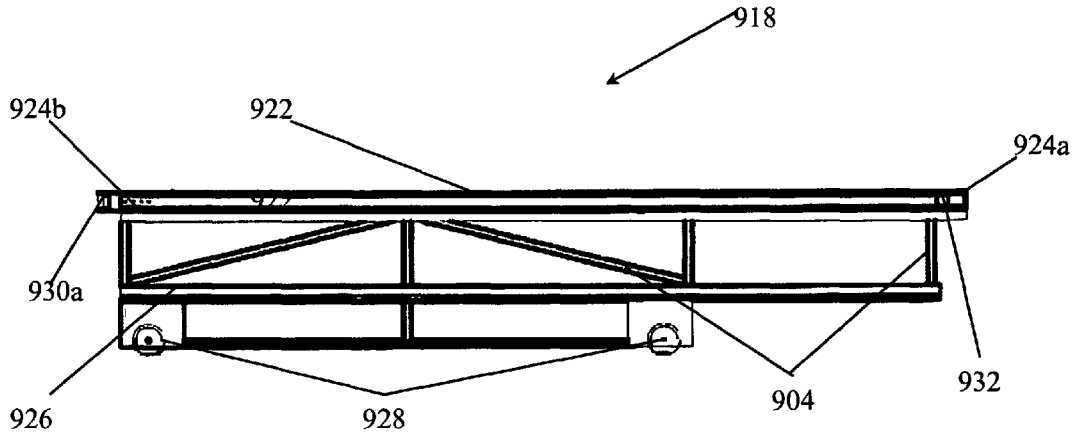
FIG. 17*c* is a side view of one embodiment of crash gate assembly for use with one embodiment of the present invention, the crash gate assembly including a crash beam, drive member, and friction-reducing member.
Figure 17D:
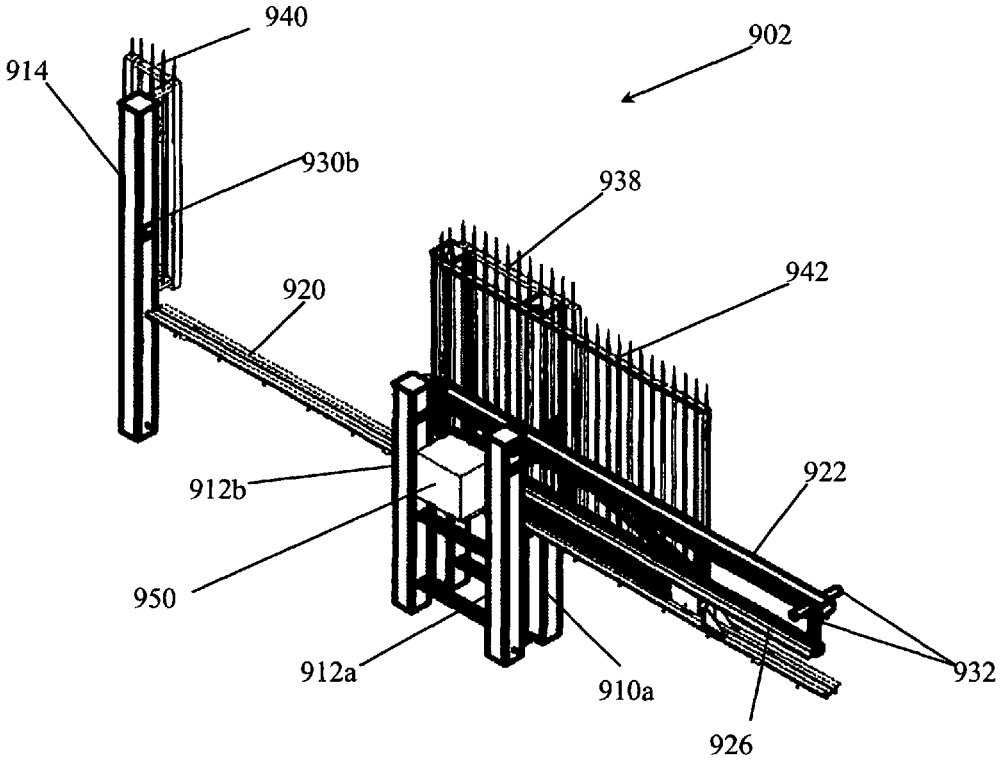
FIG. 17*d* is a view looking down from an angle on the protected side of one embodiment of the present invention, the embodiment shown including a receiver superpost assembly, an operator superpost assembly, a crash gate assembly, and a gate track assembly. In this figure, the crash gate assembly is shown in an open position.
Figure 17E:
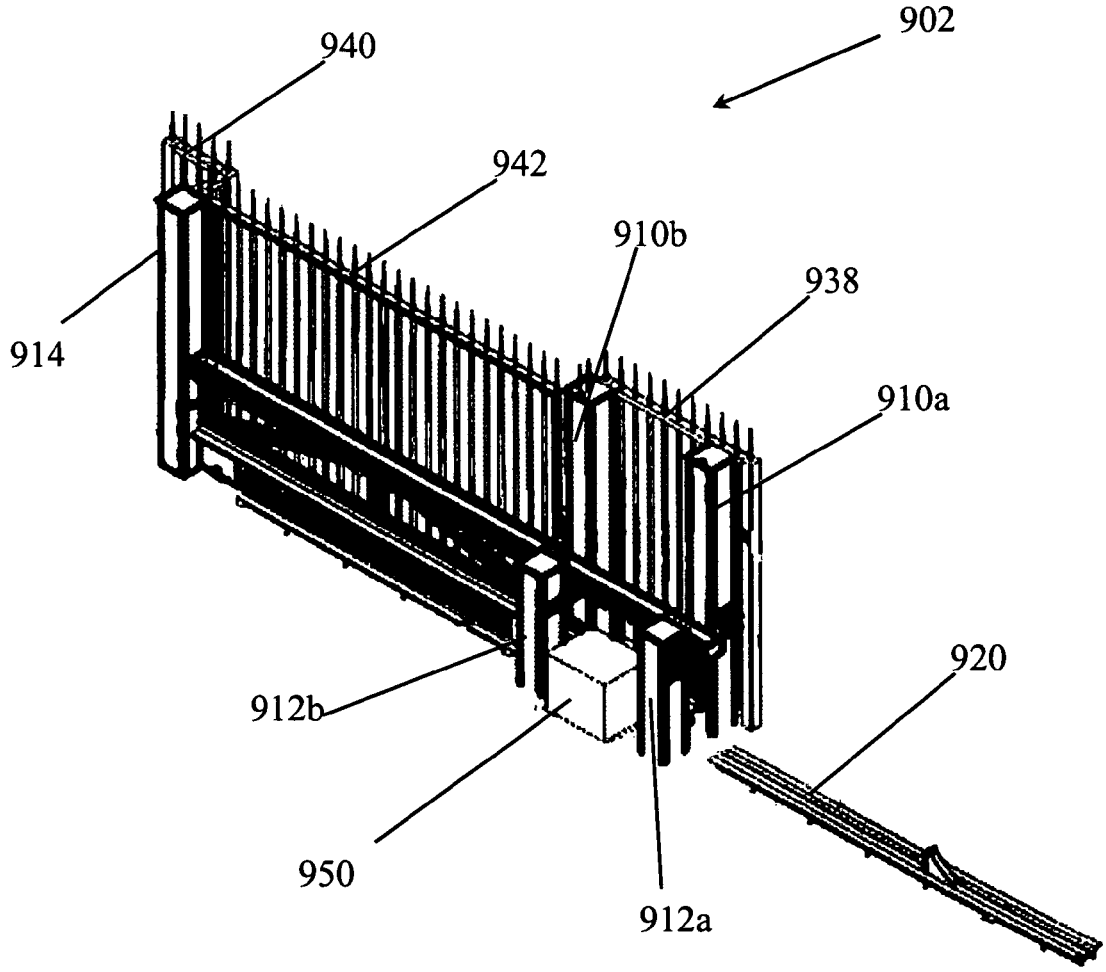
FIG. 17*e* is a view looking down from an angle on the protected side of one embodiment of the present invention, the embodiment shown including a receiver superpost assembly, an operator superpost assembly, a crash gate assembly, and a gate track assembly. In this figure, the crash gate assembly is shown in a closed position.

In the embodiment shown in FIG. 17*a*, drive operator 950 preferably drives crash gate assembly 918 along gate track 920 until one of three events occurs as follows: (1) crash gate assembly reaches a substantially open position as shown FIG. 17*d*; (2) crash gate assembly reaches a substantially closed position as shown in FIG. 17*e*; and (3) drive operator 950 substantially stops driving crash gate assembly 918 because of a manual or automatic command for the drive operator 950 to cease driving crash gate assembly 918.

Crash gate assembly 918 preferably consists of a crash beam 922 with a first end 924*a* and a second end 924*b*, a drive member such as drive rail 926, a crash gate frame 904, and at least one friction-reducing member such as wheels 928. It is appreciated by those skilled in the art that a drive member other than a rail may be used for drive operator 950 to act upon (i.e., a chain, cable, rope, or other similar objects a drive operator could operate upon) and also that other friction-reducing members other than wheels may be used to facilitate moving crash gate assembly 918 to substantially open and closed positions. Crash gate assembly 918 is preferably made from ASTM standard steel plate, tubing, and shapes. Crash beam 922 is preferably about twelve feet in length, but may range in length from about ten feet to about thirty feet. Crash beam 922 is preferably tubular in shape and the cross-sectional length of crash beam 922 ranges from between about three inches to about ten inches. Metal cable may be extended through crash beam 922 to provide reinforcement for security barrier apparatus 902.

Figure 17F:
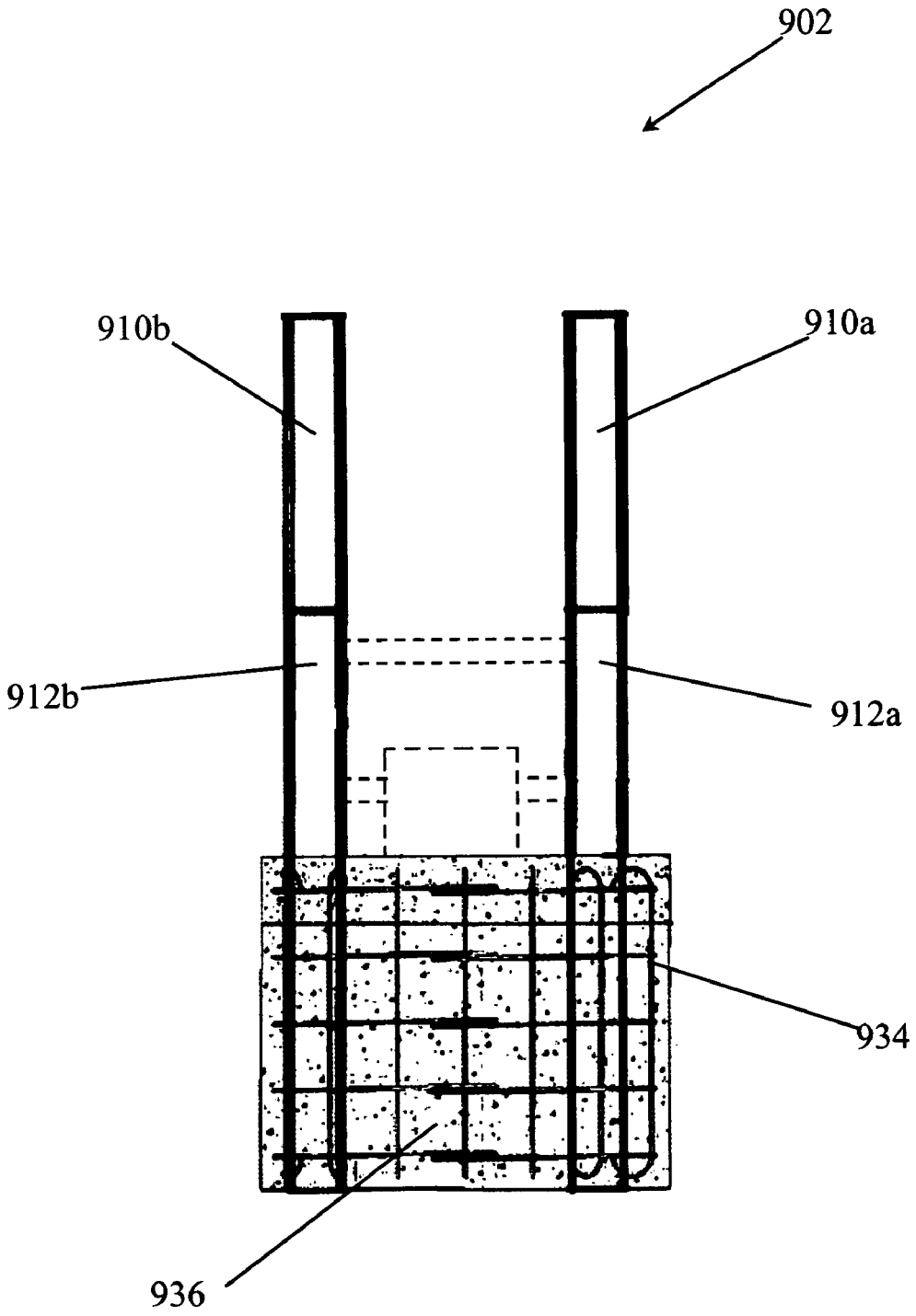
FIG. 17*f* is a side view of an operator superpost assembly for use with one embodiment of the present invention, the operator superpost shown consisting of two major operator superposts, two minor operator superposts, and concrete anchoring and metal rebar assembly.

As shown in FIG. 17*f*, operator superpost assembly 908 preferably consists of four superposts including a pair of major operator superposts 910 and a pair of minor operator superposts 912. The various components of operator superpost assembly 908 are attached together by an attachment means such as bolts, welding, or other similar attachment means known to those skilled in the art. Operator superpost assembly 908 is preferably anchored by concrete cement 936 reinforced by metal rebar 934 during installation of security barrier apparatus 902. As shown in FIG. 17*a*, receiver superpost also is preferably anchored using concrete 936 reinforced by metal rebar 934. All of the superposts in security barrier apparatus 902, including major operator superposts 910, minor operator superposts 912, and receiver superpost 914, are made from ASTM standard steel tubing preferably with about 10 inch by 10 inch cross sections. The cross sectional measurements of all of the superposts, however, may range from between about eight inches to about fourteen inches by between about eight inches to about fourteen inches. Metal I-beams like I-beam 809 and I-beam 811 in the prior embodiment may be inserted within some or all of the superposts to provide reinforcement. The receiver superpost 914 and the major operator superposts 910 preferably have a length of about thirteen feet, but may have a length ranging from between about seven feet to about twenty feet. Minor superposts 912 preferably have a length of about eight feet, but may have a length ranging from between about seven feet to about sixteen feet.

Ornamental fence structure similar to a host fence structure may be added to security barrier apparatus 902 for continuity of a fence design along a perimeter defined by an overall gate structure. FIGS. 17*b*, 17*d*, and 17*e* show an ornamental fence structure added to security barrier apparatus 902. More specifically, operator end ornamental fence 938 is attached to major operator superposts 910 by bolting, welding, or other similar attachment means known to those skilled in the art. Similarly, receiver end ornamental fence 940 is attached to receiver superpost by bolting, welding, or other similar attachment means known to those skilled in the art. Also, ornamental fence 942 is attached to crash gate assembly 918 by bolting, welding, or other similar attachment means known to those skilled in the art.

A first attachment member 930a is attached to the second end 924*b* of crash bar 922 by bolts, welding, or other similar attachment means known to those skilled in the art. First attachment member 930*a* preferably consists of a tenon like tenon 826 as discussed in the previous embodiment. A second attachment member 930*b* is attached to or located on or within receiver superpost 914. The second attachment member is preferably a tenon receptacle as like tenon receptacle 830 discussed in the previous embodiment. The first attachment member 930*a* preferably attaches to or fits within second attachment member 930*b* when crash gate assembly 918 is in a substantially closed position as shown in FIG. 17*e*. First attachment member 930*a* and second attachment member 930*b* are hereinafter referred to together as "attachment members 930."

At least one catch horn like catch horn 932 is attached to the first end 924*a* of crash beam 922, preferably by welding. The catch horn 932 shown in FIG. 17*d* preferably is a segment of metal round stock, preferably made of steel, inserted through a hole (not shown) near end 924*a*. In this embodiment, the one segment of metal round stock has been welded to both sides where the segment of metal round stock enters and exits crash beam 922. The diameter (or "cross-sectional length" if made from another shape of material) of the catch horn 932 is preferably about three inches, but may range from between about one inch to about five inches.

When the crash gate assembly 918 is in a substantially closed position, the attachment between attachment members 930 allows for security barrier apparatus 902 to withstand a greater force acting on crash gate assembly 918 than the security barrier apparatus 902 would withstand without such an attachment between attachment members 930. More specifically, the attachment between attachment members 930 transfers energy resulting from a force (such as force F6 shown in FIG. 17*b*) acting on crash gate assembly 918 to receiver superpost 914, thereby distributing such energy into the ground. Similarly, when a force such as force F6 acts on crash gate assembly 918, crash beam 922 is pushed against minor operator superposts 912, whereby energy resulting from force F6 is transferred to minor operator superposts 912 and into the ground. Catch horns 932 aid this transfer of energy to minor operator superposts 912 by helping to prevent first end 924*a* of crash beam 922 from sliding past minor operator superposts 912. When a force such as force F6 acts on crash gate assembly 918, crash bar 922 is physically influenced to bend in the approximate direction of the acting force, thereby, pulling first end 924*a* and second end 924*b* closer to one another. The attachment between attachment members 930 and the resistance offered by major superposts 910 and minor superposts 912 to catch horns 932 when a force such as force F6 acts on crash gate assembly 918 helps crash beam 922 withstand the impact of up to $1.1\times10^6$ ft-lb/s without crash beam 922 being moved substantially beyond its position relative to receiver superpost 914 and minor operator superposts 912.

Alternate embodiments of security barrier apparatus 802 and 902 may be swinging-gate type apparatus. In such alternate embodiments, similar passive engagement devices to those disclosed in the above embodiments may be used.

The foregoing description of certain exemplary embodiments of the present invention has been provided for purposes of illustration only, and it is understood that numerous modifications or alterations may be made in and to the illustrated embodiments without departing from the spirit and scope of the invention as defined in the following claims.

What is claimed is:

1. A security barrier apparatus comprising:

a first elongate structural member for preventing ingress into a protected area, wherein the first elongate structural member is disposed in a substantially horizontal plane when in a closed position and wherein a second end of the first elongate structural member includes two substantially vertically extending members extending away from the first elongate structural member in opposite directions;

an upright member, at least a portion of said upright member is on a protected side of the elongate structural member; and at least one passive engagement device for snaring the first elongate structural member, the passive engagement device comprising two horns extending substantially horizontally from the upright member in a direction substantially orthogonal to a length axis of the first elongate structural member when the first elongate structural member is pivoted into the closed position, wherein the horns are adjacent the second end of the first elongate structural member when the first elongate structural member is pivoted into the closed position such that, when the first elongate structural member is impacted in a direction toward the protected area when the first elongate structural member is in the closed position, the first elongate structural member contacts the portion of the upright member on the protected side of the elongate structural member and the horns snares the substantially vertically extending members.

2. The security barrier apparatus of claim 1, wherein the upright member is removably located within an anchored receptacle.

3. The security barrier apparatus of claim 1, further comprising a second elongate structural member, wherein when the second elongate structural member is in a closed position, said second elongate structural member is substantially parallel to said first elongate structural member in said closed position, and further wherein said upright member comprises a third upright member and a first end of the first elongate structural member is pivotally attached to a first upright member and a first end of the second elongate structural member is pivotally attached to a second upright member and the second end of the first elongate structural member and a second end of the second elongate structural member are adjacent said third upright member when the first and second elongate structural members are in said closed position.

4. The security barrier apparatus of claim 1, wherein the first elongate structural member is rotatably movable from an open position to said closed position.

5. The security barrier apparatus of claim 1, wherein the upright member is disposed entirely on the protected side of the elongate structural member.

6. The security barrier apparatus of claim 1, wherein the horns extend from the upright member at an angle of about 90 degrees in relation to a vertical axis of the upright member.

7. The security barrier apparatus of claim 1, further comprising a second upright member adjacent a first end of the first elongate structural member, and further wherein the second upright member comprises a retention bracket for limiting vertical movement of the first elongate structural member when the first elongate structural member is in said closed position.

8. The security barrier apparatus of claim 1, wherein the horns are substantially fixedly attached to the upright member.

9. The security barrier apparatus of claim 1, wherein one of the horns engages a substantially vertically extending member disposed on an end of a second elongate structural member when the second elongate structural member is impacted in the direction toward the protected area when the second elongate structural member is in a substantially closed position.

10. The security barrier apparatus of claim 1, wherein the horns engage the substantially vertically extending members when the first elongate structural member is impacted in the direction toward the protected area.

11. The security barrier apparatus of claim 1, wherein a portion of the first elongate structural member is disposed within a space between the two horns when the first elongate structural member is in said closed position.

12. A security barrier apparatus comprising an elongate structural member for preventing ingress into a protected area, wherein the elongate structural member is disposed in a substantially horizontal plane when pivoted into a closed position; a first passive engagement device connected to the elongate structural member substantially adjacent a first end of the elongate structural member, the passive engagement device comprising two horns extending substantially vertically away from opposing sides of the elongate structural member in opposite directions substantially orthogonally to a length axis of the elongate structural member; first and second upright members, wherein the first upright member is on a protected side of the elongate structural member; and two horns extending substantially horizontally from the first upright member in a direction substantially orothogonal to the length axis of the elongate structural member, wherein, when the elongate structural member is impacted in a direction toward the protected area, the elongate structural member contacts the first upright member and the two substantially vertically extending horns of the elongate structural member snare the two substantially horizontally extending horns of the first upright member.

13. The security barrier apparatus of claim 12, wherein a second end of the elongate structural member is pivotally attached to the second upright member.

14. The security barrier apparatus of claim 12, wherein the two substantially vertically extending horns are fixedly attached to the elongate structural member.

15. The security barrier apparatus of claim 12, wherein the substantially horizontally extending horns extend from the first upright member at an angle of first about 90 degrees in relation to a vertical axis of the first upright member.

16. The security barrier apparatus of claim 12, wherein the elongate structural member is rotatably movable from an open position to said closed position.

* * * * *